US012214987B2

(12) United States Patent
Shamis et al.

(10) Patent No.: US 12,214,987 B2
(45) Date of Patent: Feb. 4, 2025

(54) YARN STORAGE SYSTEM AND METHOD FOR PRODUCING TEXTILES USING SUCH YARN STORAGE SYSTEM

(71) Applicant: Aladdin Manufacturing Corporation, Calhoun, GA (US)

(72) Inventors: Martin Shamis, Cartersville, GA (US); Harlan Francis Morris, Jr., Calhoun, GA (US); Robert N. Bowen, Jr., Calhoun, GA (US)

(73) Assignee: Aladdin Manufacturing Corporation, Calhoun, GA (US)

( * ) Notice: Subject to any disclaimer, the term of this patent is extended or adjusted under 35 U.S.C. 154(b) by 404 days.

(21) Appl. No.: 17/757,114

(22) PCT Filed: Dec. 18, 2020

(86) PCT No.: PCT/US2020/065832
§ 371 (c)(1),
(2) Date: Jun. 9, 2022

(87) PCT Pub. No.: WO2021/127326
PCT Pub. Date: Jun. 24, 2021

(65) Prior Publication Data

US 2023/0002185 A1 Jan. 5, 2023

Related U.S. Application Data

(60) Provisional application No. 62/960,495, filed on Jan. 13, 2020, provisional application No. 62/950,537, filed on Dec. 19, 2019.

(30) Foreign Application Priority Data

Jan. 31, 2020 (EP) ..... 20154821

(51) Int. Cl.
*B65H 75/16* (2006.01)
*B65H 49/16* (2006.01)
(Continued)

(52) U.S. Cl.
CPC ..... *B65H 49/16* (2013.01); *B65H 61/00* (2013.01); *B65H 67/0428* (2013.01);
(Continued)

(58) Field of Classification Search
CPC .... B65H 75/16; B65H 67/0428; B65H 49/16; B65H 61/00; B65H 67/06; B65H 75/182;
(Continued)

(56) References Cited

U.S. PATENT DOCUMENTS 179,849 A * 7/1876 Drake ..... B65H 54/28 100/41
2,149,766 A * 3/1939 Gritman ..... B65H 75/18 242/118.4
(Continued)

FOREIGN PATENT DOCUMENTS

EP 0058478 A1 8/1982
EP 2885235 B1 7/2017
(Continued)

OTHER PUBLICATIONS

Extended European Search Report for European Application No. 20154821.1, dated Jul. 9, 2020, (8 pages), European Patent Office, Munich, Germany.
(Continued)

*Primary Examiner* — Amy Vanatta
(74) *Attorney, Agent, or Firm* — Meunier Carlin & Curfman LLC

(57) ABSTRACT

A yarn storage container for storing a yarn, said storage container (101) comprising a, preferably tubular, container (101), having an axial length (L), a, preferably tubular, wall
(Continued)

(501) and a first and second axial extremity (113-115), the first axial extremity (113) of said container (101) having an opening (123) for receiving an end of a yarn (200), said second axial extremity (115) of said container (101) being air-permeably closed, said wall (501) is air permeable by means of a plurality of openings (521-523) present along the axial length of said container (101). The invention further relates to a yarn storage system (1000) comprising a plurality of containers (101), to a textile production assembly (2000) and to methods of producing yarn (200) and textiles.

20 Claims, 15 Drawing Sheets

(51) Int. Cl.

| | |
|---|---|
| ***B65H 61/00*** | (2006.01) |
| ***B65H 67/04*** | (2006.01) |
| ***B65H 67/06*** | (2006.01) |
| ***B65H 75/18*** | (2006.01) |
| ***D05C 13/02*** | (2006.01) |
| ***D05C 15/18*** | (2006.01) |

(52) U.S. Cl.
CPC ..... *B65H 67/06* (2013.01); *B65H 75/16* (2013.01); *B65H 75/182* (2013.01); *D05C 13/02* (2013.01); *D05C 15/18* (2013.01); *B65H 2301/515* (2013.01); *B65H 2511/11* (2013.01); *B65H 2701/31* (2013.01)

(58) Field of Classification Search
CPC ..... B65H 2301/515; B65H 2511/11; B65H 2701/31; B65H 75/18; B65H 75/185; B65H 75/20; B65H 54/76; B65H 54/78; B65H 54/80; D05C 15/18; D05C 13/02; D03D 39/02
USPC ..... 28/289, 247, 290, 291; 242/157 R, 157.1
See application file for complete search history.

(56) References Cited

U.S. PATENT DOCUMENTS

| | | | | | |
|---|---|---|---|---|---|
| 2,281,983 | A | * | 5/1942 | Markle, Jr. | B65H 54/543 242/129.7 |
| 2,477,744 | A | * | 8/1949 | Hill | D01D 10/00 57/76 |
| 2,664,671 | A | * | 1/1954 | Courtney | B65H 75/16 65/533 |
| 2,741,009 | A | | 4/1956 | Slayter et al. | |
| 2,936,964 | A | * | 5/1960 | Tigges | B65H 49/06 68/198 |
| 3,159,902 | A | | 12/1964 | Mertens | |
| 3,279,639 | A | * | 10/1966 | Fahringer | B65H 75/16 220/4.01 |
| 3,397,437 | A | * | 8/1968 | McNeill | B65H 51/16 53/436 |
| 3,601,326 | A | * | 8/1971 | Gordon | B65H 55/046 242/163 |
| 4,392,286 | A | * | 7/1983 | Yakushiji | B65H 54/80 53/116 |
| 4,479,518 | A | | 10/1984 | Kiwior | |
| 4,729,526 | A | * | 3/1988 | Becker | B65H 75/241 242/607.2 |
| 5,178,342 | A | * | 1/1993 | Romagnoli | D06B 23/042 242/118.3 |
| 5,439,109 | A | | 8/1995 | McBride | |
| 6,634,585 | B1 | | 10/2003 | Ingram, III | |
| 8,474,115 | B2 | * | 7/2013 | Huff | D02G 1/16 28/247 |
| 10,023,330 | B2 | | 7/2018 | Schumann | |

FOREIGN PATENT DOCUMENTS

| | | | | |
|---|---|---|---|---|
| FR | 325378 | A | * | 4/1903 |
| GB | 191103580 | A | * | 11/1911 |
| GB | 966294 | A | * | 8/1964 |
| GB | 1217671 | A | | 12/1970 |

OTHER PUBLICATIONS

International Search Report and Written Opinion for International Application No. PCT/US2020/065832, dated Apr. 30, 2021, (13 pages), United States Patent and Trademark Office, US.

* cited by examiner

YARN STORAGE SYSTEM AND METHOD FOR PRODUCING TEXTILES USING SUCH YARN STORAGE SYSTEM

CROSS-REFERENCE TO RELATED APPLICATIONS

The present application is a National Stage Application, filed under 35 U.S.C. § 371, of International Application No. PCT/US2020/065832, filed Dec. 18, 2020, which claims the benefit of priority of U.S. Patent Application No. 62/950,537 filed on Dec. 19, 2019, U.S. Patent Application No. 62/960,495 filed on Jan. 13, 2020 and European Patent Application No. 20154821.1 filed on Jan. 31, 2020, the contents of which are hereby incorporated by reference in their entirety for all purposes.

FIELD OF THE INVENTION

The present invention relates to yarn storage containers and yarn storage systems, in particular to yarn storage systems for a plurality of yarns, such as yarn storage systems for yarns used as pile yarn in tufting processes. The present invention also relates to creeling systems.

The invention further relates to methods for producing textiles having a plurality of designs, methods for producing a tufted textile, and methods for producing yarn.

BACKGROUND OF THE INVENTION

Tufting machines are known in the art. A large number of yarns, even up to or more than 1000 yarns, are tufted simultaneously into a primary backing to provide a greige product. For each yarn tufted, a yarn cone is held in a rack of yarns.

When the color or design of the greige fabric is to be changed, e.g. the same design is to be tufted in a different color palette or scheme. This may require the replacement of this huge number of cones in the rack. This is labor intensive and time consuming to make one change over.

EP 2 885 235 B1 discloses a yarn packaging system comprising metered quantities of yarn for small lot size production of tufted or woven textiles. The packaging system comprises a plurality of vertical yarn containers. The yarns may be routed from the packaging system to a loom or tufting machine. A change-over between different packaging systems may be time consuming.

SUMMARY OF THE INVENTION

The present invention in the first place aims at an alternative yarn storage system, wherein, in accordance with preferred embodiments, solutions are obtained for the problem with the yarn storage systems of the prior art.

It is, amongst others, an object of the present invention to provide a yarn storage system, which reduces the change over time for changing the greige product made in the tufting industry. It is also the object of the invention to provide yarn storage containers being part of such yarn storage system, and methods to store yarn in such yarn storage system. The invention further relates to a creeling system for filling such yarn storage system.

It is a further object of the present invention to provide alternative methods for producing textiles having a plurality of designs, wherein, in accordance with preferred embodiments the change-over time between designs is limited. Further alternative methods for producing a tufted textile, and methods for producing yarn are aimed at, wherein, in accordance with preferred embodiments advantages over the methods of the prior art are obtained.

According to a first independent aspect of the invention, a yarn storage container and an yarn storage system are provided.

According to a first aspect of the invention, a yarn storage container for storing a yarn, said storage container comprising a tubular and/or elongated container, having an axial length, a tubular, and/or elongated perimetral, wall and a first and second axial extremity, the first axial extremity of said container having an opening for receiving an end of a yarn, said second axial extremity of said container being air-permeably closed, said wall is air permeable by means of a plurality of openings present along the axial length of said container. It is clear that said container is preferably tubular with a cylindrical perimetral wall, i.e. having a circular cross-section. According to variants the container may have a triangular, rectangular, square or hexagonal cross-section. Preferably the cross-section of the container is constant along the length of the container. According to a variant the cross-section of the container is tapering along a part or along the entire length thereof.

The yarn storage container is fit for storing non wound yarn, i.e. yarn in non-wound form.

Preferably, the yarn storage container is internally void. In this way, any obstacles disturbing the yarn in the container is avoided. In so doing, loading the container with yarn can be executed in a uniform manner and tension variation in the yarn can be avoided while feeding a tufter or loom with yarn from the container. According to a variant the container may comprise internal means for guiding the yarn in a desired path. For example, the container may comprise a centrally located cone or frustum. In such case, the yarn is guided to lay freely about the perimeter of the cone or frustrum, ie without tension. Said internal means may be air permeable or impermeable.

As such, the wall, e.g. the tubular wall, of the container is air permeable and allows air passing in radial direction, in particularly from the inner side of the container to the outer side of the container. The container hence has a perforated wall. In the most preferred embodiment, the container is a tubular container having a perforated tubular wall.

Each, e.g. tubular, container is preferably fit for holding only one yarn in non-wound form or appearance, wherein said yarn has a length being at least double, or at least 10 times the axial length of the container and/or a length being at least twenty, or at least hundred times the internal circumference of the cross-section of said container. Preferably said yarn has a length of at least 5 or at least 10 meter. Preferably, said length is shorter than 2 kilometers, or shorter than 750 meters, or shorter than 500 meters or shorter than 250 meters. Preferably, said length is at least 5 meters, and preferably in the range of 500 to 2500 meter. A minimum length of 5 m is desirable to allow fluent threading of the loom or tufter. Preferably a length of yarn is used which is at least 1.5 meter more than what is needed in accordance with the design to be created in the textile.

Yarns which are non-wound are yarns which are not wound or coiled on a spool or bobbin or alike. The yarn is laid down freely and unguided within the void inside the tubular container.

The second axial extremity of said container may be provided with an air permeable closing cap, such as e.g. a perforated cap from polymer or metal, which fits in or over the axial extremity of the tubular container. Alternatively, the second axial extremity of the tubular container is closed with a grid, e.g. a metal or polymer grid which is attached to the axial extremity. The open area of this air permeable closing cap may be in the range of 30 to 90% of the total surface of the cap, such as e.g. in the range of 40 to 80%, more preferred in the range of 45 to 75%.

A yarn storage system according to a second aspect of the invention comprises a plurality of yarn storage containers according to the first aspect of the invention. The working principle of the yarn storage system according to the invention is based upon the fact that such, e.g. tubular, containers can be filled with yarn by blowing yarn into the tube, e.g. by means of compressed fluid, such as air, via the opening at the first axial extremity of each of the containers. The yarn end blown into the container will be blown against the closure of the second axial extremity, and additional yarn length will gradually fill up the container as the yarn is laid freely in the volume of the tubular container. The fluid blown in, escapes the inner void of the container via the air permeable closure of the second extremity, and/or the openings in the wall. In other words, the yarns stuffs and fills the container at least partially. Once the required length of yarns is provided in the tubular container or containers, the yarn storage system may be moved to the apparatus which is to consume the yarns and convert it into the required textile product.

As an example, the yarns may be used by a tufting machine as pile yarn. During consumption of the yarns, the yarns may be gently dragged out of the tubular containers via the opening of the first axial extremity, hence in opposite direction as it was blown in. The yarn taken out of the container, will show very little to no variation on tension, which facilitates the tension control of the yarn during conversion into a textile fabric. The apparatus which is to consume the yarns and convert it into the required textile product may e.g. be a tufting machine, a weaving loom, a warp or weft knitting loom, a sewing or embroidering machine and alike.

According to some embodiments of a yarn storage container according to the first aspect of the invention, the opening of the first axial extremity of said container for receiving an end of said non-wound yarn may be provided by leaving the first axial extremity of said container uncovered, hence open.

The tubular container has a perforated, e.g. tubular, wall, i.e. a wall with openings. The openings may have any suitable shape, e.g. circular, polygonal shaped such as triangular, square, rectangular, diamond shaped, pentagonal, hexagonal and alike, optionally all of these polygonal shapes having rounded corners; capsule shaped (i.e. rectangular but terminated with half a circle at the short side of the rectangle); dog bone shaped; elliptic, or alike. At the inner side of the tube, the perforations may have a rim free of burrs. The inner rim of the perforations is preferably flush with the inner surface of the tubular container.

According to some embodiments the openings in the perforated, e.g. tubular, wall may be circular or rectangular, the latter optionally terminated with half a circle at the short side of the rectangle or having rounded corners. The rectangular opening, optionally terminated with half a circle at the short side of the rectangle (also referred to as capsule-shaped) or having rounded corners, may have its long side parallel or perpendicular to the axial length of the container.

The openings define a total sum of open area along the wall of the container, hereinafter referred to as "open area". The average open area per surface unit of inner, e.g. tubular, wall may be in the range of 0.1 to 2.5%, more preferred in the range of 0.25 to 1%. Each opening preferably has a surface area in the range of 0.003 to 0.196 $inch^2$, such as in the range of 0.008 to 0.05 $inch^2$.

Preferably, the openings may be distributed along the wall according to a geometrical pattern.

According to some embodiments, the amount of open area per surface unit of inner, e.g. tubular, wall adjacent the first axial extremity may be smaller than the amount of open area per surface unit of inner, e.g. tubular, wall adjacent the second axial extremity. The amount of open area per surface unit of inner tubular wall may increase gradually from the first axial extremity to the second axial extremity. According to some embodiments, the amount of open area per surface unit of inner wall may increase stepwise from the first axial extremity to the second axial extremity.

The amount of open area per surface unit of inner, e.g. tubular, wall may increase stepwise (with at least one step) or gradually along the axial length of the container from the first axial extremity to the second axial extremity. Possibly the amount of open area increases stepwise from the first axial extremity to the second axial extremity. As such different sections along the axial length of the, e.g. tubular, wall of the, e.g. tubular, container are defined.

The open area per surface unit of wall near the first axial extremity of the container is in the range of 0.1 to 2.5%, more preferred in the range of 0.1 to 1% such as in the range of 0.1 to 0.5%.

The open area per surface of wall near the second axial extremity of the container is in the range of 0.1 to 2.5%, more preferred in the range of 0.5 to 2.5% such as in the range of 0.5 to 1.5%.

The open area may be varied over the surface of the container by varying the number of openings per surface unit, by varying the shape of the openings, by varying the dimensions of the openings or by any combination of these measures.

According to some embodiments, the inner, e.g. tubular, wall may comprise at least two sections, the amount of open area per surface unit of inner tubular wall in the section adjacent the first axial extremity is less than the amount of open area per surface unit of inner wall in the section adjacent the second axial extremity.

In some of its preferred embodiments, the, e.g. tubular, wall has two sections, i.e. with length Le1 and Le2, each located adjacent to one of the extremities. The lengths Le1 and Le2 together is the axial length of the container. The length of the section adjacent the first axial extremity may have a length Le1 being 50 to 85% of the total axial length of the container. The length of the section adjacent the second axial extremity may have a length Le2 being 15 to 50% of the total axial length of the container. Preferably Le1 is about 75% of the total axial length of the container, Le2 being about 25% of the axial length of the container.

The open area expressed as % of the surface area of inner wall of the section adjacent the first axial extremity may be in the range of 0.1 to 2.5%, more preferred in the range of in the range of 0.1 to 1%, such as in the range of 0.1 to 0.5%. The open areas expressed as % of the surface area of inner wall of the section adjacent the second axial extremity may be in the range of 0.1 to 2.5%, more preferred in the range of 0.5 to 2.5% such as in the range of 0.5 to 1.5%.

The openings may be distributed over the, e.g. tubular, wall according to rows of openings parallel between themselves, and aligned in axial direction, i.e. parallel to the axis of the tubular container. The openings may be equidistant within the row within each section. The distances between adjacent openings in a row may vary, e.g. decrease, in case the wall has a varying, e.g. increasing, amount of open area per surface unit of wall. The number of rows of openings may be constant along the axis of the container or may vary between sections. The number of rows of openings may vary, e.g. increase, in case the wall has a varying, e.g. increasing, amount of open area per surface unit of wall for a given section. Or a combination of both these measures may be provided to provide varying open areas along the axial length of the container.

According to some embodiments, the first axial extremity of said, e.g. tubular, container may comprise a lid substantially closing said first axial extremity, said lid is provided with a hole for providing said opening for receiving an end of the yarn or non-wound yarn. Such a lid may provide for a further minimization of the risk of the yarn becoming entangled and/or tensioned. Furthermore, the lid prevents the yarn from being removed from the container unintentionally for example while moving the container on a slope.

The first axial extremity of said container may be provided with a lid, such as e.g. a lid from polymer or metal, which fits in and/or over the axial extremity of the, e.g. tubular, container. The lid may be e.g. a plug or a cap. The lid may be removably attached to the first axial extremity. It may be attached by clips or clamps, or just may fit in and/or over the containers first axial extremity, where it fits and stays in place due to friction forces.

According to some embodiments, the first axial extremity of said, e.g. tubular, container may comprise a grommet for receiving said end of said non-would yarn, said grommet being preferably mechanically coupled to the first axial extremity of said container. The grommet may fit into the hole of a lid substantially closing the first axial extremity.

The grommet may be part of said lid, thereby providing the opening to the lid. The grommet may be a tube, typically of relative short length, such as 0.5 to 2 inches. The inner diameter of the tube opening may vary, such as between 0.25 and 2 inches, such as between 0.5 and 1 inches. The grommet may be electrically conductive.

The grommet may be made from metal, such as iron, steel, copper, aluminum, bronze, messing, or any alternative metal alloy, or may be made from electrically conductive polymers, like carbon fiber or carbon powder filled polymer, such as carbon powder filled polypropylene, polyethylene, polyamide, polyvinylchloride or alike. In the alternative, the grommet may be porcelain.

According to some embodiments the lid may comprise one or a plurality of small openings along the contact zone where said lid contacts said first axial extremity.

The openings may be small perforations, holes, slits and alike. Via these small openings a laminar air stream may be provided by gently blowing or sucking air through the small openings into the inner volume of the, e.g. tubular, container.

In general, the yarn storage container according to the first aspect of the invention may comprise means for providing a laminar air stream in axial direction from the first axial extremity to the second axial extremity along the walls of the, e.g. tubular, container. This in fact provides a second, independent aspect of the present invention. According to said second independent aspect of the invention, a yarn storage container for storing a yarn is provided, said storage container comprising a tubular and/or elongated container, having an axial length, a tubular, and/or elongated perimetral, wall and a first and second axial extremity, the first axial extremity of said container having an opening for receiving an end of a yarn, said container further comprising means for providing a laminar air stream in axial direction, preferably from the first axial extremity to the second axial extremity, along the walls of the container. It is clear that the yarn storage container of the second aspect may show the features of the yarn storage container of the first aspect of the invention and/or the preferred embodiments thereof.

The laminar air stream may prevent the yarn from bridging inside the container, i.e. from forming an obstruction in the inner part of the container by self-accumulating before having reached the end of the inner void of the container. Such accumulation may lead to the yarn becoming entangled, and to a lack of volume to store sufficient yarn inside the container.

According to some embodiments of the first and/or second aspect, the first axial extremity of said, e.g. tubular, container may comprise a brush for contacting said end of said yarn.

The brush may be fitting into a hole provided in a lid which substantially closes the first axial extremity.

Possibly the bristles of the brush close said opening or hole. The bristles contacting the non-wound yarn in or passing through the opening is provided with a minimum of tension when the yarn is drawn out of the container. The brush may be a straight brush with bristles all being substantially parallel, or a circular brush with bristles oriented towards a central point. For a circular brush, the bristles may overlap at the central point, but preferably leave a central opening, e.g. an opening of about ¼" to 1", such as about ¾".

The bristles may be electrically conductive and may be grounded to reduce the static loading of the yarn passing the opening.

The storage container may comprise a grounding system for grounding the electrically conductive brush, grommet, container or tube.

According to some embodiments, the container may comprise means for providing a laminar air stream in axial direction, preferably from the first axial extremity to the second axial extremity, at least along the walls of the tubular container.

According to some embodiments, the container may comprise means to create a sub-atmospheric pressure in the, e.g. tubular, container via the second axial extremity.

With sub-atmospheric pressure is meant a pressure being less than the ambient pressure.

Causing such sub-atmospheric pressure via the second axial extremity, will help the yarn end, and the length of yarn blown into the container, to move more easily and completely up to the second axial extremity. It may also help to increase the amount of yarn that can be introduced in to the container because it may compress the inserted yarn in a direction towards the second axial extremity.

This means to create sub-atmospheric pressure in combination with lids comprising one or a plurality of small openings along the contact zone where the lid contacts the first axial extremity may be part of, or may be sufficient to provide a means to create a laminar stream along the inner wall of the, e.g. tubular, container.

According to some embodiments, the container may have, in radial cross section, a circular, oval, square or rectangular cross section profile.

According to some embodiments, the surface of a radial cross section of the tubular container may be between 0.75 and 13 $inch^2$. More preferred, the surface of a radial cross section of the tubular container may be between 1.5 and 13 $inch^2$, such as between 2 and 13 $inch^2$.

According to some embodiments, the container may be provided from steel, aluminum, cardboard or polymer, preferably a polymer chosen from the group consisting of polypropylene, polyethylene, polyamide, polystyrene and polyvinylchloride.

Preferably the container may be provided from any suitable material, preferably from metal, like aluminum, or polymer, preferably polyvinylchloride (PVC), polyethylene (PE), polypropylene (PP) or polystyrene (PS). The, e.g. tubular, wall is preferably transparent, allowing visual inspection of the yarn stored in the container.

The, e.g. tubular, containers may have a wall with a thickness which may be between 0.042 inch and 0.1 inch, when the containers are metal or metallic containers.

The, e.g. tubular, containers may have a wall with a thickness which may be between 0.0625 and 0.25 inch when the containers are cardboard or polymeric containers.

According to some embodiments, the container is a cardboard or polymeric, e.g. tubular, container, the inner wall of said container being made electrically conductive.

It is in general preferred that at least the inner wall of said container contains electrically conductive paths and/or said inner wall is electrically conductive. As such build-up of electrostatic charges can be prevented. The prevention of electrostatic charges may keep the yarn from sticking to the inner wall of the container, and thus may prevent the yarn from bridging inside the container, i.e. from forming an obstruction in the inner part of the container by self-accumulating before having reached the end of the inner void of the container. Such accumulation may lead to the yarn becoming entangled, and to a lack of volume to store sufficient yarn inside the container.

The above described problem of bridging is especially prevalent with such yarns that are based on PET (polyethylene terephthalate), PTT (poly tri methylene terephthalate), PP (polypropylene), PA (polyamide), wool or cotton.

The electrical conductivity of the inner wall of the container may be obtained by providing e.g. an electrically conductive coating along the whole inner wall. Alternatively, coating strips in axial direction or a spiraling strip along the length of the tubular container, made out of electroconductive material may be provided. Such electroconductive coating material may e.g. be silver, gold, aluminum, copper, brass, bronze, tin or similar metal or metallic coatings.

As the yarn storage containers form part of a storage system, said system may comprise a grounding system for grounding electrically conductive, e.g. tubular, containers or the electrically conductive inner wall of the, e.g. tubular containers. This grounding system may be the same grounding system for grounding the electrically conductive grommets.

According to some embodiments, the axial length of the, e.g. tubular, container may be between 15 and 110 inch. More preferred, the axial length of the, e.g. tubular, containers may be between 20 and 100 inch, such as between 24 and 96 inch.

According to a third aspect of the invention, a yarn storage system is provided, the system comprising at least two yarn storage containers according to the first and/or second aspect of the invention.

According to some embodiments, all containers may have identical dimensions.

According to some embodiments, the containers may be organized in a rack.

One rack may comprise 16 to 1024 containers, more preferred 36 to 1000 containers, which may be organized in a matrix setting. The matrix may comprise 4 to 32 rows and 4 to 32 columns, more preferred 6 to 30 rows and 6 to 30 columns.

Preferably, a container is positioned adjacent to a plurality of other similar containers in a matrix, wherein at least a part of the outer wall of said container is free from contact with any of said plurality of adjacent containers, in other words, preferably the stack comprises voids at least partially defined by the outer wall portions of a plurality of containers. Preferably such voids are open in the length direction of the containers, namely at the surface of the stack comprising said first axial extremities and/or at the surface of the stack comprising said second axial extremities. Preferably, said voids are closed in any direction transverse to the length direction in that they are bound for example by outer wall portions of adjacent containers. For example, in the case of a tubular and cylindrical container, contacts or near contacts may be formed at the topmost and bottommost part and at the leftmost and the rightmost part of the outer wall, however several zones of the outer wall, for example the zone in between the topmost part and for example the rightmost part of the outer wall, are free from contact with any other container in the stack. The availability of voids in between the stacked containers is beneficial for the air to escape the stack while filling the respective containers in the stack with yarn.

The racks may be provided with a transporting system, rendering the yarn storage system movable. As an example, the rack may be provided with a plurality of wheels.

According to some embodiments, the first axial extremities of all, e.g. tubular, containers may be coplanar.

Typically also the second axial extremities of all, e.g. tubular, containers are coplanar as preferably all tubular containers are of equal length, and preferably are identical.

According to some embodiments, the, e.g. tubular, containers may be oriented in a vertical position. According to the most preferred embodiments, the, e.g. tubular, containers may be oriented in a horizontal or substantially horizontal position. Preferably the containers are oriented in a level manner. However, in accordance with a variant, they may be positioned slopingly, for example with the first extremity downwardly directed, and preferably under an angle of 15° or less with the horizontal plane. The horizontal or slightly sloping orientation of the containers may improve the taking out of the yarn, for example when connected with a tufting machine. Due to the horizontal orientation or the substantially horizontal orientation of the containers, several storage systems, for example for subsequent designs to be tufted on the same tufting machine, can be placed on top of each other, and the change-over from one storage system to the other can be made fluently. Also, the filling of the containers of several storage systems can be carried out with a more compact machine in a more fluent manner.

The horizontal or substantially horizontal positioning of the containers within the storage system forms in itself a particular independent aspect of the present invention, being a yarn storage system comprising at least two yarn storage containers for storing unwound, untensioned and/or freely provided yarn, wherein said containers are elongated and comprise a first extremity from which yarn can be drawn, an wherein said containers are oriented horizontally or substantially horizontally in said yarn storage system, wherein, preferably, a sloping orientation comprises a first extremity of said containers being oriented downwardly and/or a sloping orientation comprises said containers making an angle with the horizontal plane of 15° or less. It is clear that the storage system of the present particular independent aspect of the invention may show the features of one or more of the preferred embodiments of the third aspect of the invention, without the containers necessarily having to show the air permeable wall and impermeable second extremity of the containers of the first aspect of the invention and/or the means for creating a laminar air stream as provided for in the second aspect of the invention.

Each, e.g. tubular, container in the storage system of the invention may be provided with at least one yarn detector, e.g. an electronical, mechanical or optical yarn detector, detecting the presence of a yarn at the opening of the first axial extremity of said containers. The yarn detectors may be part of a yarn detecting system, further equipped with a processing unit to receive signals of said yarn presence detectors indicating the presence or non-presence of yarns, and a signal generating means to generate a signal when at least one yarn detector fails to detect a yarn. Then the yarn storage system cooperates with machinery consuming yarn, e.g. a tufting machine, this machine may use the signal of said yarn detecting system to interrupt its yarn consumption when one or more containers fail to have a yarn present, e.g. when it ran out of yarn stored in said container.

According to some embodiments, the yarn storage system further may comprise a yarn end holding means comprising a number of apertures or slots, said number of apertures or slots being identical or more than the number of containers of the yarn storage system, each aperture or slot being fit to receive one yarn end from one of the containers.

The apertures or slots may all be adjacent one next to the other in a row, or may be organized in two or more rows, optionally in zig-zag setup. Each slot or aperture may be provided with a ceramic tube to prevent the passing yarn to wear out the aperture or slot.

The yarn end holding means typically may be provided as a beam, i.e. rectangular, balk-like piece of metal or plastic in which the apertures or slits are provided. Most preferably the yarn end holding means has a comb-like structure.

According to a fourth independent aspect of the invention, a yarn storage system is used to supply textile machinery with yarn.

According to some embodiments, the use of a yarn storage system according to the third aspect of the invention is provided, for providing yarn to a textile machine, such as to provide pile yarn to a tufting machine. Preferably, such yarn storage system contains at least one yarn storage container per needle of the tufting machine. Preferably, such yarn storage system contains a number of yarn storage containers which is identical to or a multiple of the number of needles in the tufting machine.

The yarn storage system may be used to store bulked continuous filament yarns, such as used by tufting machines to provide pile yarn of the tufted greige, hence of the tufted carpet.

It is clear that the yarn storage system may as well be used to provide yarns to other textile producing equipment, such as warp knitting machines, as warp yarn for weaving looms, such as carpet weaving looms, and alike.

According to a fifth independent aspect of the invention, a method to store yarns in provided.

The method to store yarn according to this fifth aspect comprises the steps of a) Providing a yarn storage system according to the third aspect of the invention;
b) Providing N spools of yarn, N being an integer equal or more than 1;
c) Repeating
   selecting one or at least one, e.g. tubular, container to at least partially be filled with yarn of said spool;
   defining for said selected container the length of yarn to be inserted;
   selecting one of the N yarns;
   injecting said defined length of said selected yarn from said spool by means of a fluid, such as pressured air, in the selected container;

for a plurality of containers, optionally until all containers are at least partially filled with yarn.

According to some embodiments, the N may be more than 1. Preferably, the number of yarns used will be between 2 and 10, even more preferably between 2 and 8, such as 3, 4, 5, 6, 7 or 8 yarns.

According to some embodiments, the injecting of said yarn in said tubular containers may be performed by a robot, comprising a spool rack comprising said N spools of yarn.

According to some embodiments, the robot may comprise a memory unit memorizing filling date, being for each, e.g. tubular, container memorizing its position,
the yarn to be selected and
the length of yarn to be injected;

the robot comprising an input means for inputting said filling date in said memory unit, said robot comprising a control unit defining the filling sequence of said containers and controlling the injection of said yarns in said containers while executing said filling sequence.

The robot hence fills each container with the correct yarn. It first ensures it selects the yarn end needed to fill the next tubular container, brings its injection instrument in front of the opening at the axial extremity of the selected container, and injects yarn while measuring the length of yarn, either directly or indirectly.

According to some embodiments, when N>1, the yarns of said N spools of yarn all may be mutually different yarns.

The yarns may e.g. differ in color or color tone, or may have a different linear weight or composition.

According to some embodiments, the yarns may be bulked continuous filament yarns.

More preferably the yarns used are so-called direct tuft yarn, which are yarns being more delicate as compared to standard BCF yarn.

According to some embodiments, the defined lengths of yarns may be in the range of 2000 to 10000 ft.

More preferred, the injected lengths are in the range of 2000 to 10000 ft of yarn, even more preferred in the range of 3500 to 7500 ft of yarn.

It is understood that any type of yarn can be held in the yarn storage system. Yarns with a titer (i.e. the weight per length unit) in the range of 900 to 4000 denier may be stored, such as in the range of 1100 to 3600 denier.

According to some embodiments, the system may comprise a vortex injector for injecting said defined length of said selected yarn in the selected, e.g. tubular, container. Any type of injector can be used. Preferably the injector uses the Venturi-effect to suck the yarn into the injector, where it is further propelled by the gas, preferably air, flowing in the Venturi tube. The person skilled in the art is well aware that the Venturi-effect is created by a pressure drop at a constriction in a liquid or gas flow. Substances, in this case the yarn, can be sucked into said flow at the constriction and are further propelled by the liquid or gas flow.

The vortex injector preferably uses 2 to 15 cubic foot per minute (CFM), more preferred 3 to 8 CFM such as 5 to 8 CFM, for example CFM of air. The latter is in particularly advantageous when direct tuft yarn is used.

The method has the advantage that with a limited number of spools of yarns, a wide variety of organized yarn storage can be provided. The yarn storage being organized meaning that it is known for each, e.g. tubular, container, which yarn is contained and at which length. As such a plurality of yarns can be made ready for use, e.g. by a tufting machine, providing one yarn end for each needle of the tuft machine, while only a limited number of spools need to be at hand. The lengths of the yarns in the containers can be measured accurately and may be limited. As such a given "minor" length of a tufted greige carpet can be provided with little yarn waste being created. The latter because the yarn length in the containers can be calculated according to the yarn which will be consumed by the tufting machine to make the length of greige. For each kind of yarn or yarn color needed, only the number of spools are to be provided which together comprise the needed length of yarn. Only the leftovers on these spools used might be seen as waste. The number of spools is not linked to the number of needles in the tufting machine, hence a very significant waste reduction is obtained.

The possibility to move the yarn storage system enables filling the yarn storage system at a dedicated location where the robot is present. The filled and emptied yarn storage systems can move to the position where the textile machine will take out the yarn, which causes only limited storage place being needed as compared with yarn creels carrying the same number of spools as now, e.g. tubular, containers are present.

Said defining for said selected container the length of yarn to be inserted is preferably executed on the basis of the desired length of a desired design of a textile to be produced. Said defining may be done by means of suitable software converting a design of a particular length into a set of yarns with defined properties, such as length, color, quality, needed for producing the design. Preferably, the length of yarn to be inserted is slightly larger than the actual length needed in the textile product, for example the actual length to be inserted can be 100 to 110% of said needed length. The surplus length allows for start-up and running out of the design, as well as for threading the textile machine producing the desired textile.

According to a further, sixth aspect of the invention, a yarn storage container is provided, similar to the yarn storage container of the first aspect and/or second aspect of the invention, however where the, e.g. tubular, wall or walls of the container are air tight, i.e. they do not have openings along their axial length. In particular, yarn storage containers with a container with a limited axial length are provided, e.g. with axial lengths of less than or equal to 1.5 m, e.g. less than or equal to 1 m. such containers preferably have a circular cross section with a diameter preferably less than 4 inch.

According to this sixth aspect, a yarn storage container for storing a yarn is provided, said storage container comprising a, e.g. tubular, container, having an axial length, a tubular wall and a first and second axial extremity, the first axial extremity of said tubular container having an opening for receiving an end of a yarn, said second axial extremity of said tubular container being air-permeably closed, said tubular wall is air impermeable.

All features of the yarn storage containers according to the first and/or second aspect of the invention, which features are not related to the air permeability of the, e.g. tubular, wall, can be applied for the yarn storage containers of this sixth aspect.

According to a seventh aspect, a plurality of yarn storage containers in accordance with the sixth aspect and/or the preferred embodiments thereof, can be used to provide a yarn storage system according to this seventh aspect of the invention. All features of the yarn storage system according to the third aspect of the invention, which features are not related to the air permeability of the tubular wall, can be applied for the yarn storage containers of this seventh aspect.

According to an independent eighth aspect a yarn storage system is provided, wherein said yarn storage system comprises at least a first and a second yarn storage container, said first and second storage containers being elongated, preferably tubular, and having an axial length and an elongated perimetral wall extending between a first and second axial extremity, the first axial extremity of said container having an opening for receiving an end of a yarn, with as a characteristic that said yarn storage system further is provided with at least one of the following features, or with a combination of two or more of the following features:

- the feature that said first and second containers are positioned, or positionable, in said storage system with their axial length directed in a horizontal plane. With this feature it is obtained that several yarn storage systems can be placed on top of each other while the yarns are accessible at the first axial extremity;
- the feature that said first and second containers are positioned, or are postionable, in said storage system with their axial length directed slopingly with respect to said horizontal plane, said slope being at an angle of 15° or less with said horizontal plane. With this feature it can be obtained that the yarn is slightly more or slightly less kept in position in the respective container. The former may be preferred while filling the respective containers or when moving the yarn storage container, and the latter may be preferred while discharging or drawing the yarn form the respective containers for example when feeding a textile machine;
- the feature that said first and second containers are positioned, or are postionable, in said yarn storage system with their axial length directed slopingly with respect to said horizontal plane, with said first axial extremity being directed downwardly. With this feature the discharging or drawing of the yarn out of the respective container from the first axial extremity is enhanced. This positioning may be useful when feeding a textile machine with the respective yarn;
- the feature that said yarn storage system comprises a plurality of containers, including said first and second containers, wherein said plurality of containers is positioned in a matrix, wherein said matrix is preferably substantially uniform. With a uniform matrix it is meant that the axes of the respective containers are positioned equidistantly from each other in a horizontal and/or vertical direction;
- the feature that said yarn storage system comprises a plurality of containers, including said first and second containers, wherein the first and second containers are positioned adjacent to a plurality of other similar containers in a matrix, wherein at least a part of the outer wall of said first and second container is free from contact with any of said plurality of adjacent containers; Preferably, the matrix or stack of containers comprised in said yarn storage system comprises voids defined by the outer wall portions of a plurality of containers as described above in connection to the third aspect of the invention;

the feature that at least one of said first and second containers, is provided with a yarn detector and/or the feature that said yarn storage system comprises means for detecting the yarn and/or yarn end of at least one of said first and second containers. The signal from such yarn detector may be used to directly or indirectly control a textile machine that draws yarn from said yarn storage system;

the feature that at least one of said first and second containers, is provided with means for creating a laminar air stream, preferably from the first axial extremity to the second axial extremity. Such laminar air stream may be advantageous for a good filling and/or discharging of the first and/or second container;

the feature that at least one of said first and second containers show the features of the first and/or second aspect of the invention and/or the preferred embodiments thereof;

the feature that said yarn storage system is directly linked to a tufting or weaving machine, for example in that yarns from at least one of said first and second container are positioned to be tufted or woven in said machine. Preferably, the yarn storage system comprises at least as many yarn storage containers as the number of yarns necessary for feeding the respective machine. Preferably, the yarn storage system comprises between 16 and 1024 yarn storage containers;

the feature that said yarn storage system comprises a yarn end holding means comprising a number of apertures or slots, said number of apertures or slots being preferably identical or more than the number of containers of the yarn storage system, each aperture or slot preferably being fit to receive one yarn end from one of the containers. This feature minimizes the risk of the yarns becoming entangled and/or may enable a fluent feeding of a textile machine;

the feature that at least one of said first and second container comprises a lid substantially closing said first axial extremity, said lid being provided with a hole for providing said opening for receiving an end of the yarn. The provision of a lid at the first axial extremity may provide for a guiding of the yarn end upon discharging the yarn from the respective container for example when feeding a textile machine, while restricting the movement of the bulk of the yarn inside the container;

the feature that at least one of said first and second container comprises an electrical conductive layer or strips on the inner wall thereof. As explained in connection to the first and second aspect, such layer or strips may minimize the risk of bridging of the yarn somewhere midway the container. As such, the axial length of the containers may be made longer for enlarging the filling capacity without significant difficulties upon filling or discharging;

the feature that at least one of said first and second container is electrically grounded.

This feature avoids any disturbing effects from build-up of electrical charges to the safe and trustworthy operation of said yarn storage system;

the feature that at least one of said first and second container is configured for tensionless storage of yarn. The yarn is available in the internal void of said first and/or second container in an unwound condition, or, in other words, the yarn freely lays in the internal void of said first and/or second container. In this way tension plucks while discharging the yarn from the first and/or second container can be largely avoided;

the feature that said first and/or second container are dimensioned to have an internal void with a ratio axial length over diameter that is at least ten, or 25 and larger. In the cases where the container is not tubular and cylindrical, the diameter is that of the largest circle that can be fit in the internal void. These slender containers allow for a compact yarn storage system. Preferably, such slender containers are provided with a means to dissipate static electricity from the inner walls, such as a means comprising an electrically conductive coating or strips on the inner wall, to avoid undesired build up or bridging of the yarn somewhere midway the first and second axial extremity;

the feature that said yarn storage container is provided with a data storage for storing data concerning the yarns contained in said first and/or second yarn storage containers and/or possible further containers. Such data may comprise one or more of color indications, length, type of individual yarns, their location in the yarn storage container, the design for which they had been provided in the yarn storage container, production planning data;

the feature that said yarn storage container is provided with a scannable data tag, e.g. a barcode or QR code, for example linking to an address where any data about the yarns contained in the plurality of yarn storage containers can be obtained, e.g. using a computer network or the world wide web. Such data may comprise one or more of color indications, length, type of individual yarns, their location in the yarn storage container, the design for which they had been provided in the yarn storage container, production planning data.

It is clear that, although the above features have been described in connection to a first and second container within the yarn storage system, that the yarn storage system may contain a plurality of containers, such as between 10 and 10000, preferably from 16 to 1024 containers. Preferably, at least a majority of the number of containers, and even better all containers in a yarn storage system are similar in that they show at least one of the above mentioned features, and preferably two or more of the above mentioned features, in common.

According to a ninth aspect of the invention, a yarn storage system according to the seventh and/or eighth aspect is used to supply textile machinery with yarn. It is clear that this yarn storage system may be used to provide yarns to any textile producing equipment, such as tufting looms, warp knitting machines, as warp yarn for weaving looms, such as carpet weaving looms, and alike.

According to an independent tenth aspect, the present invention also is a textile production assembly, wherein said textile production assembly at least contains a first yarn storage system and a textile producing machine, wherein said machine produces textile on the basis of continuous yarn and/or is chosen from the list consisting of a tufting machine, a weaving machine and a knitting machine, with as a characteristic that said first yarn storage system comprises at least a first and a second yarn storage container for storing continuous yarns, said first and second storage containers being elongated, preferably tubular, and having an axial length and an elongated perimetral wall extending between a first and second axial extremity, the first axial extremity of said container having an opening for receiving an end of a yarn, wherein said first yarn storage system further comprises means for communicating with said textile producing machine, in particular for communicating the lack of a yarn from said first and/or said second container. The ability of the yarn storage system to communicate with the textile producing machine gives way for new advantageous control possibilities of the textile production assembly and prevention of erroneous production.

For example, the yarn storage container may comprise a data storage comprising any data about the yarns that are contained in the plurality of yarn storage containers. Such data may comprise one or more of color indications, length, type of individual yarns, their location in the yarn storage container, the design for which they had been provided in the yarn storage container, the production planning data. According to a variant the yarn storage container may comprise a data storage containing an address where any data about the yarns contained in the plurality of yarn storage containers can be obtained, e.g. using a computer network or the world wide web.

Preferably, said first yarn storage system comprises the features of any of the third, seventh, or eighth aspect of the invention, and/or the preferred embodiments thereof.

Preferably, said first yarn storage system is provided with at least the following features in combination:

- the feature that at least one of said first and second containers, is provided with a yarn detector and/or the feature that said first yarn storage system comprises means for detecting the yarn of at least one of said first and second containers;
- the feature that said yarn detector creates a signal to be directly or indirectly communicated to said textile machine through said means for communication.

Any information about the status of the yarn may be provided by the yarn detector to said textile machine through said means for communicating. Such information may contain data about the tension in the yarn, the availability and/or lack of a yarn, the remaining and/or consumed length of the yarn.

Preferably, said means for communicating are chosen from the list of electric and electronic means, wherein said means for communicating preferably comprise a wireless link between said first storage system and said textile machine. It is of course not excluded that the communication would be executed by means of magnetic, pneumatic or hydraulic means, or by means of optical signals.

Preferably, said textile machine is configured to pause the operation, or to proceed with yarn from an alternative container in said first yarn storage system, or from a different yarn storage system, when it receives a signal through said means for communication, for example the signal that the respective yarn is lacking.

Preferably, said textile machine assembly further comprises means for connecting one or more of the yarns of said first yarn storage system to one or more yarns of a second, preferably similar, yarn storage system. Due to the presence of such means, rethreading of the textile machine, which is entirely time consuming, can be avoided. Preferably, said means for connecting comprise a support for positioning one or more yarns of said first yarn storage system and one or more yarns of said second yarn storage system, wherein said mean for connecting further comprises a welding equipment for connecting said one or more yarns of said first yarn storage system with said one or more yarns of said second yarn storage system, preferably while being positioned on said support; said support preferably comprising a set of spacing individual yarns from said first yarn storage system and/or second yarn storage system respectively.

According to a further eleventh aspect of the invention, a method to store yarns in provided.

The method to store yarn according to this eleventh aspect comprises the steps of

- Providing a yarn storage system according to the seventh aspect of the invention;
- Providing N spools of yarn, N being an integer equal or more than 1;
- Repeating
  - selecting one or at least one, e.g. tubular, container to at least partially be filled with yarn of said spool;
  - defining for said selected container the length of yarn to be inserted;
  - selecting one of the N yarns;
  - injecting said defined length of said selected yarn from said spool by means of a fluid, such as pressured air, in the selected container;
- for a plurality of containers, optionally until all containers are at least partially filled with yarn.

All features of the method according to the fifth aspect of the invention, which features are not related to the air permeability of the, e.g. tubular, wall, can be applied to these methods of this eleventh aspect.

It is clear that the above first till eleventh aspect are in particularly advantageous when used for producing textile at small lot size.

With the aim of providing further alternative methods that are suitable for small lot size production, the present invention in accordance with its twelfth independent aspect is a method for producing textiles with a plurality of designs, wherein each design is created from a set of, preferably continuous, yarns, with as a characteristic that the method comprises

- providing a first set of yarns for a first of said plurality of designs; wherein one or more of said first set of yarns is provided in a first yarn storage system, wherein said first yarn storage system comprises a first plurality of containers;
- providing a second set of yarns for a second of said plurality of designs; wherein one or more of said second set of yarns is provided in a second yarn storage system, wherein said second yarn storage system comprises a second plurality of containers;
- producing said first design at least by drawing yarn from one or more of said first plurality of containers;
- connecting one or more of the yarns of said first plurality of containers to yarns of said second plurality of containers;
- producing said second design at least by drawing yarn from one or more of said second plurality of containers.

Preferably said containers are yarn storage containers having the features of the first and/or second and/or sixth aspect and/or the preferred embodiments thereof and/or said yarn storage systems have the features of the third and/or seventh and/or eighth aspect and/or the preferred embodiments thereof. The method of the twelfth aspect may be performed using a textile production assembly having the features of the tenth aspect and/or the preferred embodiments thereof.

By connecting the yarns, preferably all yarns, of said first set to the yarns, preferably all yarns, of said second set, a fluent changeover from the first to the second of said plurality of designs can be attained. A fluent changeover may lead to a minimized waste production in between the designs.

Preferably, each container from which yarn is drawn for said first, respectively second design, comprises at most one continuous length of a yarn, wherein said continuous length preferably corresponds to the length of said yarn needed in the first or second design respectively, with a margin, i.e. a surplus amount of yarn, of preferably less than 10%.

Preferably, said containers are tubular.

Preferably, said connecting comprises welding and/or heating one or more, preferably all, yarns of said first set to thermally connect it to one or more, preferably all yarns, of said second set.

Clearly, preferably said yarns are connected one to one.

Preferably, said connecting comprises positioning one or more of the yarns of said first plurality of containers and one or more of the yarns of said second plurality of containers on a support, and connecting said yarns while being on the support. Preferably, said support comprises a set of teeth for spacing individual yarns.

Preferably, all of the yarns of said first set and said second set are drawn from respective containers, wherein said first set comprises at least all the yarn needed for the first design and said second set comprises at least all the yarn needed for said second design. Preferably, said first set and said second set comprises between 100 and 110% of the yarn needed for the respective design, wherein a surplus length of the yarn may be used in a change-over zone from the first to the second of said plurality of designs and/or for threading the respective textile machine.

Preferably, said method further comprises the step of cutting the textile in at least two pieces, each comprising at least one of the first and second designs.

Preferably, said method further comprises the step of cutting the textile in at least three pieces being two pieces each comprising at least one of the first and second designs, and a third piece positioned in between a first and a second design, wherein said third piece may be considered a change-over zone or waste.

Preferably, said first set of yarns is different from said second set of yarns at least in that the number of containers being filled with yarn of a particular color, thickness, and/or material in said first plurality of containers is different from the number of containers being filled with yarn of the same particular color, thickness and/or material respectively in said second plurality of containers. Other differences between the first and second set of yarns may include a difference in entanglement and/or twist and/or shape of the filaments contained in the yarns.

It is clear, that in accordance with a particular independent aspect, the present invention also relates to a semi-product obtained or obtainable with the method of the twelfth aspect and/or the preferred embodiments thereof, wherein said semi-product is, for example, a textile comprising the first design, the second design and a zone in between a first and second design, wherein said zone contains both yarns from said first and from said second set.

It is noted that the first and second of the plurality of designs may in themselves contain repetitions of an individual, e.g. floral, design. The invention in accordance with the above twelfth aspect in particularly concerns the change-over between a first and second design that are different in pattern, color, quality, and/or relief. In other words, it concerns a change-over in the design that requires a different set of yarns.

With the aim of providing a yarn production method which is particularly suitable to be applied with one or more of the other aspects of the invention, the present invention, in accordance with a thirteenth independent aspect, is a method of producing yarn preferably for feeding a tufting machine, comprising spinning a plurality of filaments;

converting said plurality of filaments to a yarn;

directly providing said yarn in a container; said containers preferably being yarn storage containers according to the first and/or second aspect and/or the preferred embodiments thereof and/or being comprised in a yarn storage systems showing the features of the third, seventh and/or eighth aspect and/or the preferred embodiments thereof;

optionally feeding a tufting machine by drawing said yarn from said container.

With directly providing said yarn in a container, it is meant that the method of the thirteenth aspect is free from winding operation in between the spinning and the provision of the yarn in said container. Such method avoids an unnecessary winding operation and possible build-up of residual stresses in the yarn.

Preferably, said converting comprises entangling and/or twisting. Said converting may comprise entangling the plurality of filaments via air jets to produce the said yarn, wherein said yarn is preferably suitable for tufting. Said converting may comprise twisting the plurality of filaments to produce the said yarn, wherein said yarn is preferably suitable for tufting and/or wherein said twisting the plurality of filaments comprises applying a S twist or a Z twist. Preferably, said twisting the plurality of filaments comprises adjusting an amount of twist to produce yarns of different texture.

Preferably, said directly providing said yarn in a container comprises filling said container with an amount of yarn corresponding to the amount of yarn needed for a textile design to be produced on a portion of a textile machine, with a margin, i.e. a surplus length, of less than 10%.

Preferably, said directly providing said yarn in a container comprises filling said container with an amount of yarn, cutting the yarn, filling a subsequent container with a different or equal amount of yarn.

Preferably, said method further comprises drawing out yarn from said container for feeding a textile machine.

It is noted that said plurality of filaments may comprise filaments of different colors and/or filaments of different titers.

Preferably, the method of said thirteenth aspect does comprise said step of feeding a tufting machine, wherein preferably a tufted carpet is produced.

With the same aim as in the thirteenth aspect, the present invention, in accordance with a fourteenth independent aspect, is a method of producing a tufted textile, comprising:

spinning a plurality of filaments;

converting said plurality of filaments to a plurality of yarns;

injecting at least one yarn of the plurality of yarns into at least one container; said containers preferably being yarn storage containers according to the first and/or second aspect and/or the preferred embodiments thereof and/or being comprised in a yarn storage systems showing the features of the third, seventh and/or eighth aspect and/or the preferred embodiments thereof; said injecting is preferably executed directly, i.e. without intermediate winding operations of the yarn between the spinning and the injecting; and drawing the at least one yarn from the at least one container to a tufting machine to produce a tufted textile. Preferably, the tufted textile comprises a tufted carpet.

Said converting said plurality of filaments to a plurality of yarns may comprise entangling and/or twisting the plurality of filaments to produce the plurality of yarns.

Said injecting at least one yarn of the plurality of yarns may comprise injecting multiple yarns into multiple containers.

Said injecting at least one yarn into at least one container may comprise blowing a first yarn into a first extremity of a first container.

Said drawing at least one yarn from the at least one container to a tufting machine may comprise drawing the first yarn from the first extremity of the first container into a tufting machine to produce tufted textile. According to a variant, said drawing at least one yarn from the at least one container to a tufting machine may comprise drawing the first yarn from a second extremity of the first container into a tufting machine to produce tufted textile.

Preferably said at least one container is a tubular container.

With the aim of providing a system ideally suitable for providing a yarn storage system as in the previous aspects, filled with yarn, the present invention in accordance with a fourteenth independent aspect, is a creeling system, comprising:

a plurality of yarn storage systems each comprising a plurality of yarn storage containers or being configured to receive one or more yarn storage containers; said containers preferably being yarn storage containers according to the first and/or second aspect and/or the preferred embodiments thereof and/or being comprised in a yarn storage systems showing the features of the third, seventh and/or eighth aspect and/or the preferred embodiments thereof;

at least one set of a plurality of injectors for injecting defined lengths of yarn into the plurality of yarn storage containers; and a controller comprising a memory and configured to direct the at least one set of plurality of injectors to inject the defined length of yarn into the plurality of yarn storage containers.

Preferably, said memory comprises information for at least a plurality of yarn storage containers, preferably each storage container, in each of said plurality of yarn storage systems. Preferably, for each yarn storage container of the plurality of yarn storage systems, the memory comprises information of its position in the corresponding yarn storage system, the yarn to be selected for the yarn storage container, and the length of the yarn to be injected in the yarn storage container. Preferably said information is at least partially transferred to a data storage comprises in the respective yarn storage system and/or to an address accessible over a computer network or the world wide web. In the latter case, said address is preferably provided to the respective yarn storage system by uploading it to its data storage and/or by providing a scannable tag to said yarn storage system.

It is clear that any data uploaded from the memory of said creeling system to said yarn storage system may be communicated to a textile machine, for example when the yarn storage systems forms part of a textile production assembly having the features of the tenth aspect and/or the preferred embodiments thereof.

Preferably, the plurality of injectors inject the defined lengths of yarn into the plurality of yarn storage containers in the plurality of storage systems simultaneously.

Preferably, the creeling system is configured to receive a plurality of yarn storage systems, for example at least two or at least four. The creeling system preferably comprises at least one set of a plurality of injectors for each of the yarn storage systems that it can receive. Preferably each injector of said set injects a single type of yarn, i.e. yarn from the same color, type, quality and material, into the containers of a particular yarn storage system. Preferably, each injector is able to inject yarn in a plurality of columns of the stack of containers, for example because the sets of injectors are configured to move horizontally, preferably at least over a distance equal to twice, and preferably at least four times, the horizontal distance D1 between the yarn storage containers. Each injector may also able to inject yarn in a plurality of rows of the stack of containers, as the injectors may be configured to move vertically, preferably at least over a distance equal to four times the vertical distance D2 between the yarn storage containers. Preferably, the injectors are configured to move at least such a distance that they can inject yarn in all containers of a particular row.

The independent and dependent claims set out particular and preferred features of the invention. Features from the dependent claims may be combined with features of the independent or other dependent claims, and/or with features set out in the description above and/or hereinafter as appropriate.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention.

This description is given for the sake of example only, without limiting the scope of the invention. The reference figures quoted below refer to the attached drawings, wherein.

The same reference signs refer to the same, similar or analogous elements in the different figures.

DESCRIPTION OF ILLUSTRATIVE EMBODIMENTS

The present invention will be described with respect to particular embodiments. It is to be noticed that the term "comprising", used in the claims, should not be interpreted as being restricted to the means listed thereafter; it does not exclude other elements or steps. It is thus to be interpreted as specifying the presence of the stated features, steps or components as referred to, but does not preclude the presence or addition of one or more other features, steps or components, or groups thereof. Thus, the scope of the expression "a device comprising means A and B" should not be limited to devices consisting only of components A and B. It means that with respect to the present invention, the only relevant components of the device are A and B.

Throughout this specification, reference to "one embodiment" or "an embodiment" are made. Such references indicate that a particular feature, described in relation to the embodiment is included in at least one embodiment of the present invention. Thus, appearances of the phrases "in one embodiment" or "in an embodiment" in various places throughout this specification are not necessarily all referring to the same embodiment, though they could.

Furthermore, the particular features or characteristics may be combined in any suitable manner in one or more embodiments, as would be apparent to one of ordinary skill in the art.

According to a first independent aspect of the invention, a yarn storage system is provided.

Figure 1A:
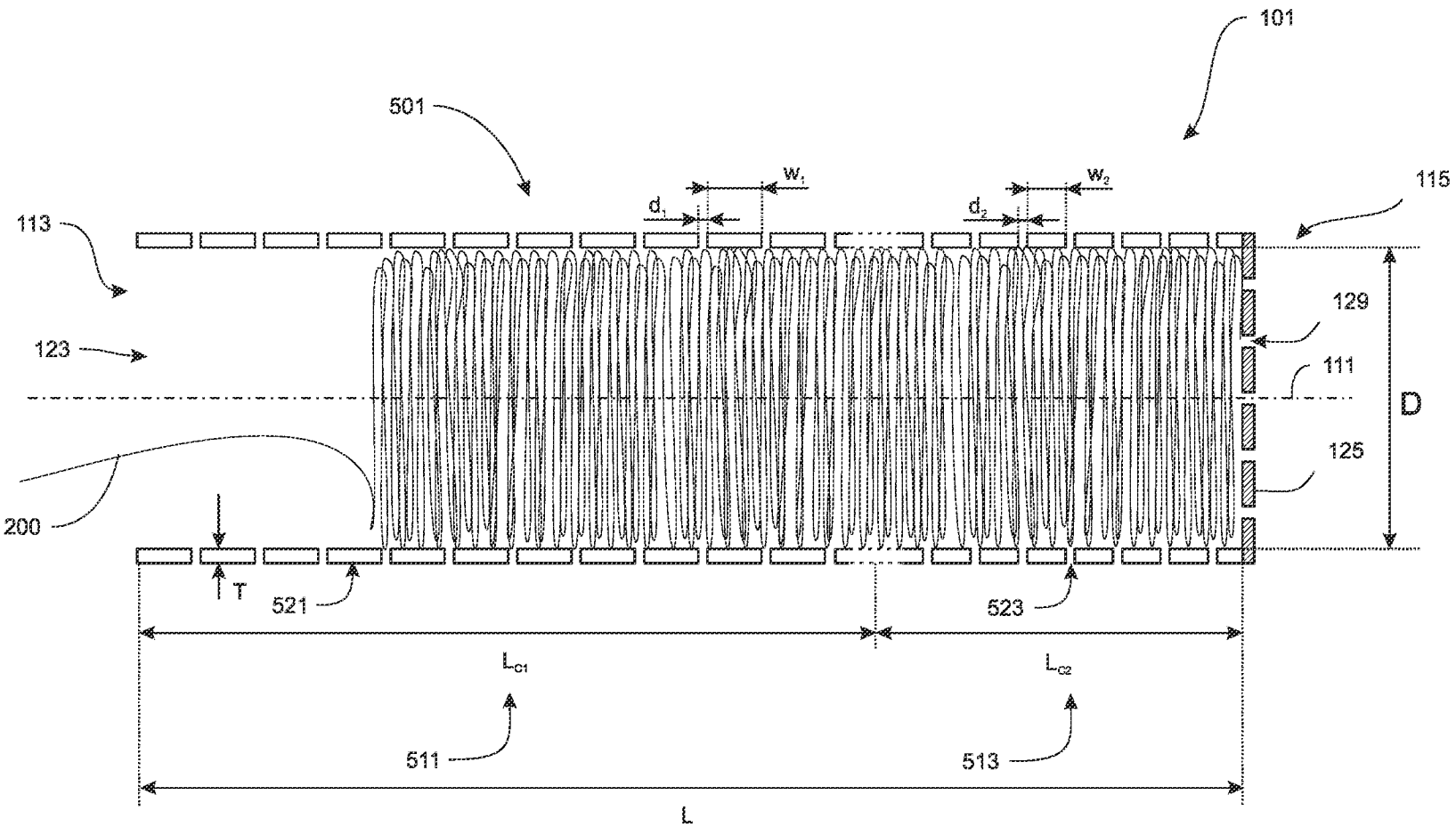
FIG. 1A to 1D are schematic views of tubular containers from a yarn storage system according to the invention.

A yarn storage system for storing multiple non-wound yarns will be described hereinafter by making use of the figures. In FIG. 1A, an example of a yarn storage container comprising a container 101 is shown. In the example the container 101 is tubular and cylindrical.

More in particular, an axial cross section of such tubular container is provided. The tubular container 101 has an axial length L of 72 inch in the axial direction 111 and a first axial extremity 113 and a second axial extremity 115. Each tubular container is fit for holding one non-wound yarn 200 having a length at least double of the axial length of the tubular container. The first axial extremity 113 has an opening 123 for receiving an end of one of the non-wound yarns. The second axial extremity 115 of each of the tubular containers is air-permeably closed, e.g. by means of a polymer grid 125 being welded along the circumference of the second axial extremity 115.

The tubular container 101 has a wall thickness T of ⅛ inch, has a circular radial cross section and an inner diameter D of 2.78 inch.

Notably, the ratio of the axial length L to the inner diameter D is larger than 10, and in this case even larger than 25.

The tubular wall 501 comprises two sections, a first section 511 with length Le1 being 54 inch, and a second section 513 with length Le2 being 18 inch. In each of the sections, the tubular wall has apertures or openings 521 and 523. In section 511, the tubular wall has 4 rows of apertures 521 along its circumference, the rows equidistant one to the other along the circumference. Each row has 18 apertures 521 being circular apertures with diameter d1 of ⅛ inch. The distance wall-to-wall w1 between the apertures in axial direction is 2.875 inch. The distance center to center between the apertures in axial direction is d1+w1 being 3 inch. This first section has an inner tube surface area of 487 $inch^2$. The apertures 521 together provide 0.884 $inch^2$ open surface. Hence the open areas expressed as % of the surface area of tubular wall in this section 511 is 0.18%.

In section 513, the tubular wall has 6 rows of apertures 531 along its circumference, the rows equidistant one to the other along the circumference. Each row has 18 apertures or openings 531 being circular apertures with diameter d2 of ⅛ inch. The distance wall-to-wall w2 between the apertures in axial direction is 0.875 inch. The distance center to center between the apertures or openings in axial direction is d2+w2 being 1 inch. This second section has an inner tube surface area of 163 $inch^2$. The apertures 531 together provide 1.325 $inch^2$ open surface. Hence the open areas expressed as % of the surface area of tubular wall in this section 531 is 0.82%.

In total, the inner surface area of the tube is 650 $inch^2$, and is provided with in total 2.209 $inch^2$ open area by means of the apertures in the first and second section. The open areas expressed as % of the surface area of tubular wall in its totality is 0.34%.

Figure 1B:
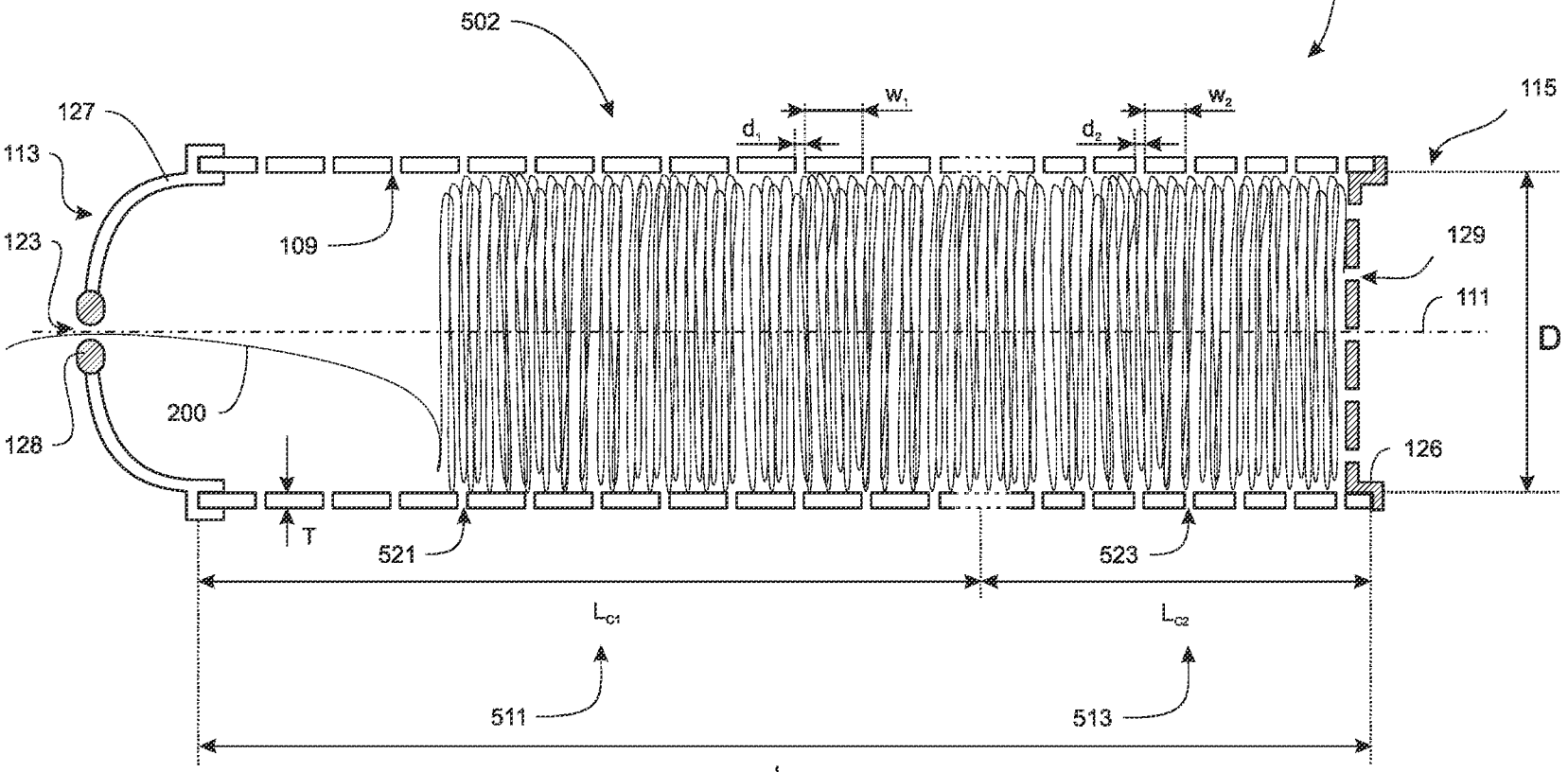

An alternative, also tubular, container 102 is shown in FIG. 1B. The tubular container 102 again has an axial length L of 72 inch in the axial direction 111 and a first axial extremity 113 and a second axial extremity 115. Each tubular container is fit for holding one non-wound yarn 200 having a length at least double of the axial length of the tubular container. The first axial extremity 113 has a cap 127 provided with an electrically conductive grommet 128 which on its term defines the opening 123 for receiving an end of one of the non-wound yarns. The second axial extremity 115 of each of the tubular containers is air-permeably closed, e.g. by means of a cap 126 being slid in the container 102 along the circumference of the second axial extremity 115.

The grommet 128 is a copper grommet with a diameter of the opening of ¾ inch. Both caps 127 and 126 are made out of polymer. The cap 126 is air permeable as it is provided with a plurality of openings 129.

The tubular container has a wall provided with apertures or openings identical to the wall set out in FIG. 1*a*.

Figure 1C:
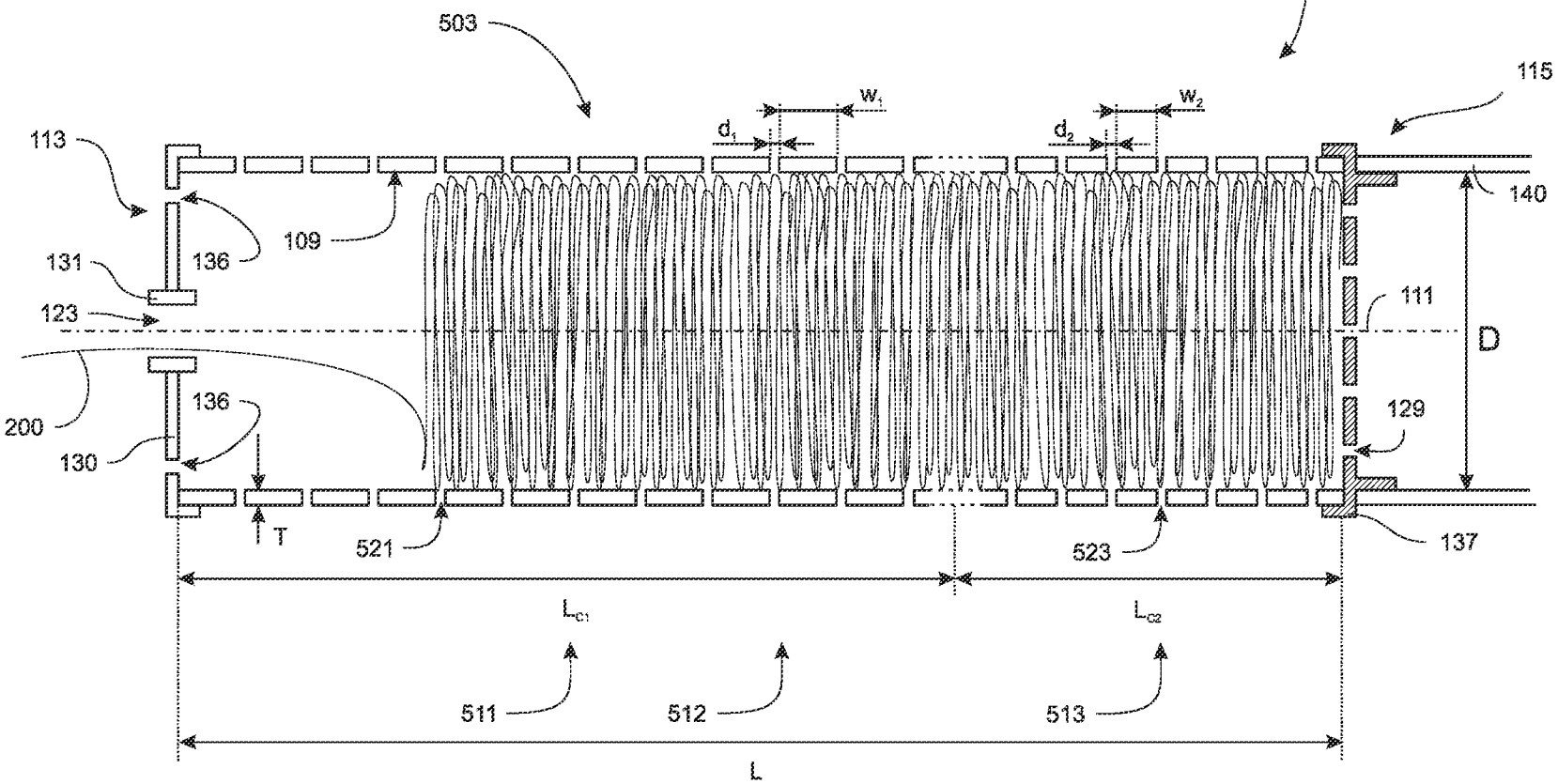

An alternative tubular container 103 is shown in FIG. 1C. The tubular container 103 again has an axial length L of 72 inch in the axial direction 111 and a first axial extremity 113 and a second axial extremity 115. Each tubular container is fit for holding one non-wound yarn 200 having a length at least double of the axial length of the tubular container. The first axial extremity 113 has a cap 130 provided with an electrically conductive tube 131 which on its term defines the opening 123 for receiving an end of one of the non-wound yarns. The cap has plurality of small openings 136 along the contact zone where the cap 130 contacts the first axial extremity 113. The second axial extremity 115 of each of the tubular containers is air-permeably closed, e.g. by means of a cap 137 being slid on the container 104 along the circumference of the second axial extremity 115.

To the outer end of the cap 137, a vacuum system 140 is mounted to create a minor lower air pressure in the tubular container 103. Via the openings 136, air is sucked into the tubular container 103 and creates a laminar flow in the tubular container 103 at least along the walls 109 of the tubular containers.

Caps 130 and 137 are made out of polymer. The cap 137 is air permeable as it is provided with a plurality of openings 129.

The tubular container has a wall provided with apertures or openings identical to the wall set out in FIG. 1*a*.

Figure 1D:
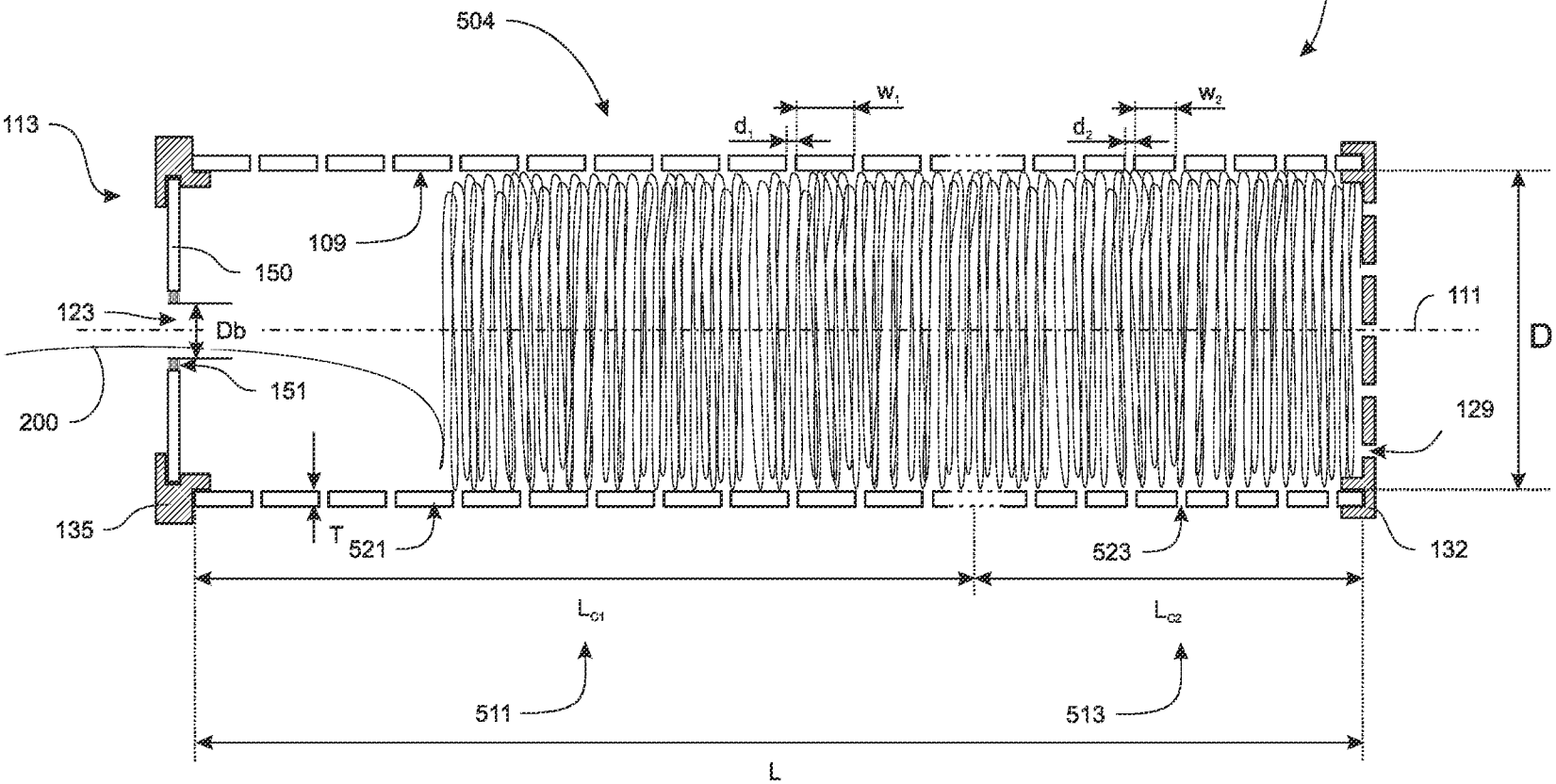

Still another alternative tubular container 104 is shown in FIG. 1D. The tubular container 104 again has an axial length L of 72 inch in the axial direction 111 and a first axial extremity 113 and a second axial extremity 115. Each tubular container is fit for holding one non-wound yarn 200 having a length at least double of the axial length of the tubular container. The first axial extremity 113 has a cap 135 provided and, optionally, an electrically conductive, brush 150 which defines a circular opening between the bristles 151 of diameter db being ¾ inch. As such an opening 123 for receiving an end of one of the non-wound yarns is defined. The yarn end 200 may contact the bristles 151. The second axial extremity 115 of each of the tubular containers is air-permeably closed, e.g. by means of a cap 132 being slid on the container 103 along the circumference of the second axial extremity 115. The second axial extremity 115 of each of the tubular containers is air-permeably closed, e.g. by means of a cap 137 being slid on the container 104 along the circumference of the second axial extremity 115.

Caps 132 and 135 are made out of polymer. The cap 132 is air permeable as it is provided with a plurality of openings 129.

The tubular container has a wall provided with apertures or openings identical to the wall set out in FIG. 1*a*.

In the alternative, the tubular containers of FIGS. 1A to 1D may have another radial cross section, e.g. rectangular, square or oval. The dimensions of these cross sections may be chosen such that the overall cross sectional surface is about equal to the ones as shown in the FIGS. 1A to 1D.

The grommets 128, the tubes 131 and/or the circumference of the first axial extremity 113 may be electrically conductive and may be grounded.

Optionally the inner wall 109 may be provided with an electrically conductive layer or strips, which on their turn may also be grounded.

The tubular containers of FIGS. 1A to 1D comprise a tubular wall made from transparent polystyrene.

In FIGS. 2*a* to 2*f*, several suitable tubular walls 601 to 606, fit for being used as part of the tubular container are shown schematically. In FIGS. 2*a* to 2*e*, the tubular wall has two sections 611 and 613.

Figure 2A:
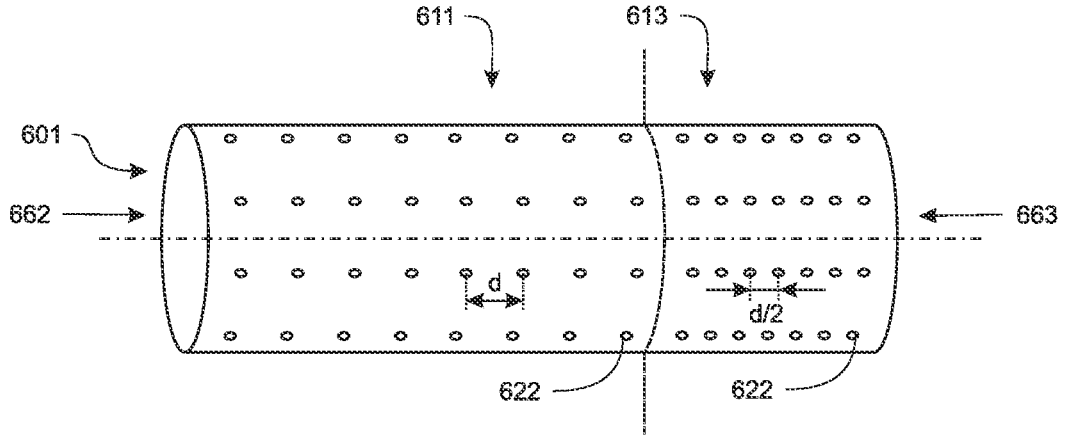
FIG. 2A to 2F are schematic views of tubular containers from a yarn storage system according to the invention.

In FIG. 2*a*, the first section 611 comprises 8 rows of circular openings 622, all on a given center to center distance d one to the other in axial direction. In the other section 613, closer to the second axial extremity 663, the section comprises 8 rows of circular openings 622, all on a center to center distance being only d/2 one to the other in axial direction. Therefore, the total open area per surface unit in section 613 is double the total open area per surface unit in section 611.

Figure 2B:
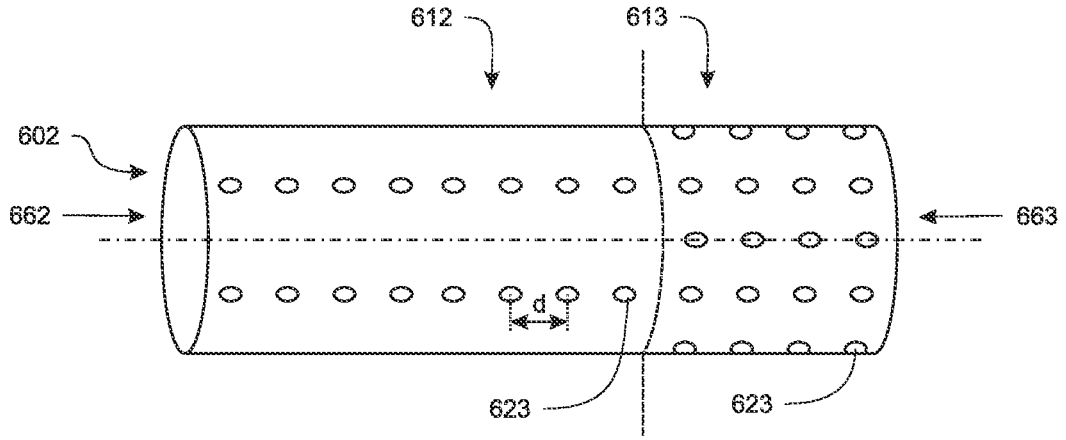

In FIG. 2*b*, the first section 611 comprises 4 rows of circular openings 623, all on a given center to center distance d one to the other in axial direction. In the other section 613, closer to the second axial extremity 663, the section comprises 8 rows of identical circular openings 623, all on a center to center distance d one to the other in axial direction. Therefore, the total open area per surface unit in section 613 is double the total open area per surface unit in section 611.

Figure 2C:
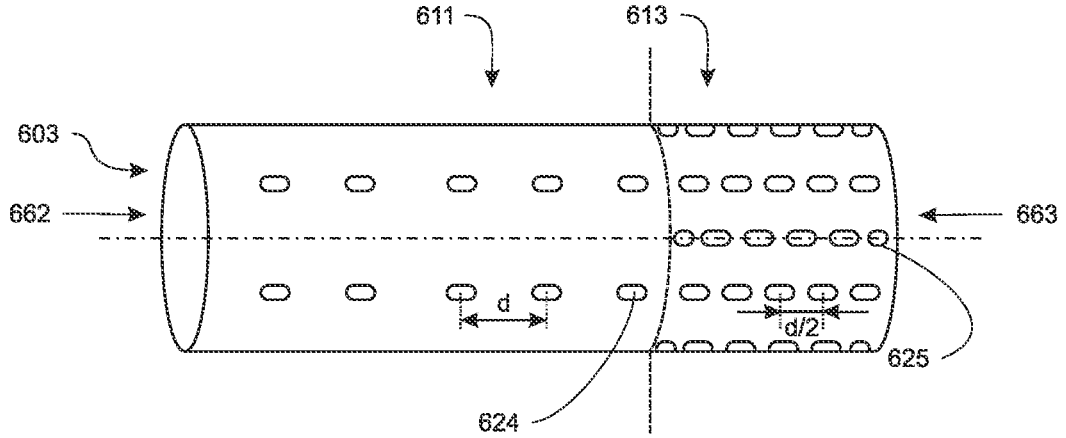

In FIG. 2*c*, the section 611 comprises 4 rows of capsule shape like openings 624, all on a given center to center distance d one to the other in axial direction. In the other section 613, closer to the axial extremity 663, the section comprises 4 rows of n identical capsule shape like openings 624, all on a center to center distance d/2 one to the other in axial direction. The section 613 further comprises 4 additional rows intermediately positioned between the other rows. Each of these intermediate rows comprise n−1 identical capsule shape like openings 624, with additionally two further openings 625 having a circular shape with surface half of the surface of the capsule shape like openings 624. All openings 624 have their vertical walls parallel with the axial direction of the tubular container.

Therefore, the total open area per surface unit in section 613 is double the total open area per surface unit in section 611.

Figure 2D:
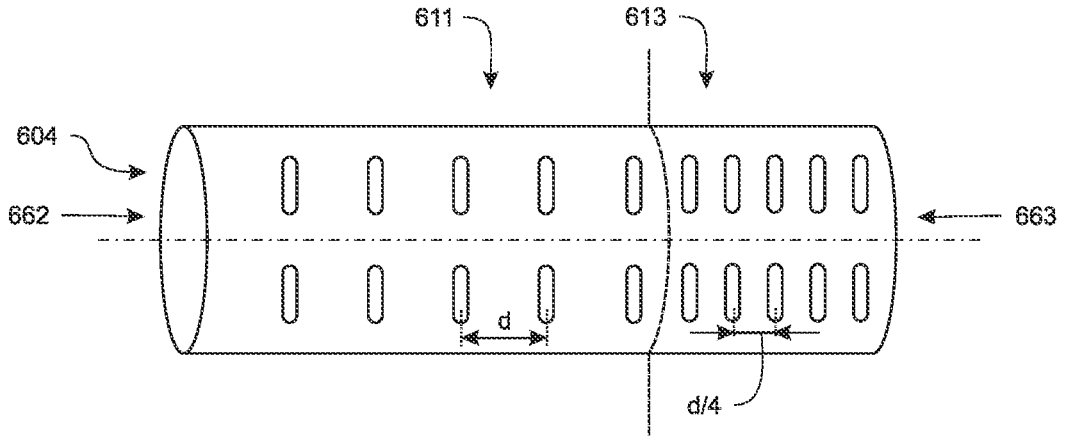

In FIG. 2*d*, the section 611 comprises 4 rows of capsule like openings 626, all on a given center to center distance d one to the other in axial direction. In the other section 613, closer to the axial extremity 663, the section comprises 4 rows of capsule like openings 626, all on a center to center distance being only d/4 one to the other in axial direction. Therefore, the total open area per surface unit in section 613 is quadruple the total open area per surface unit in section 611.

Figure 2E:
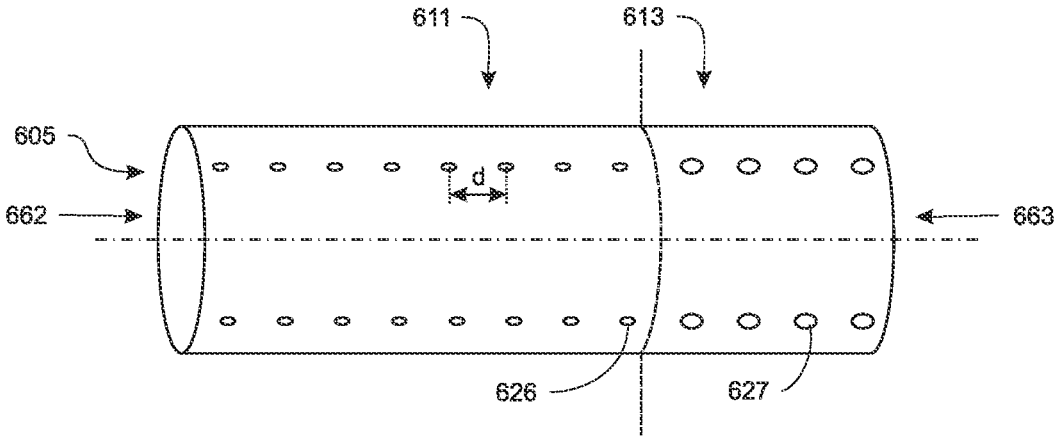

In FIG. 2*e*, the section 611 comprises 4 rows of circular openings 627, all on a given center to center distance d one to the other in axial direction. In the other section 613, closer to the axial extremities 663, the sections comprise 4 rows of circular openings 626, all on a center to center distance being d one to the other in axial direction. The radius of the circular openings 628 is double the radius of the circular openings 627. Therefore, the total open area per surface unit in section 613 is quadruple the total open area per surface unit in section 611.

For all embodiments in FIGS. 2*a* to 2*e*, the amount of open area per surface unit of tubular wall increase stepwise (with at least one step) along the axial length of the tubular container.

Figure 2F:
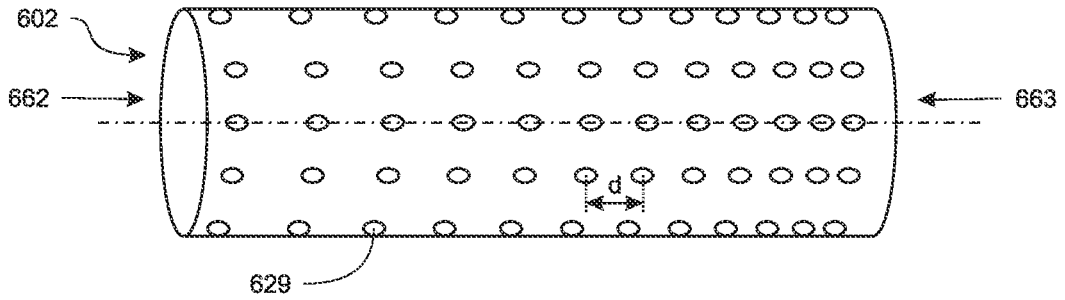

In FIG. 2*f*, the tubular wall has no sections but is provided along its length with four rows of openings 629, all being identical and circular shaped.

Consecutive openings in a row are on a given center to center distance d one to the other in axial direction. From the first axial extremity 662 towards the second axial extremity 663, the interdistance d between adjacent openings 629 decrease gradually.

As such the amount of open area per surface unit of tubular wall increases from first axial extremity 662 towards the second axial extremity 663. Hence the amount of open area per surface unit of tubular wall increase gradually along the axial length of the tubular container.

The skilled person understands that the various measures taken to locally modify the amount of open area per surface unit of tubular wall as applied in FIGS. 2*a* to 2*f* may be combined to vary this open area per surface unit of tubular wall.

Figure 3:
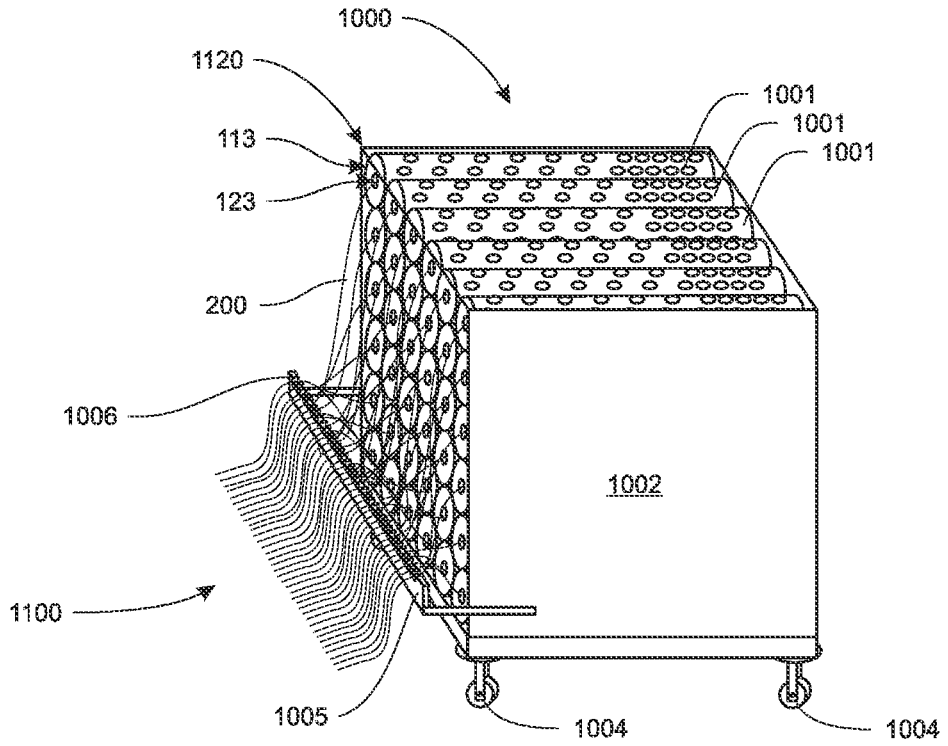
FIGS. 3 and 4 are schematic views of yarn storage systems according to the invention.

As shown in FIG. 3, a plurality of such tubular containers 1001 are matrix-wise mounted in a rack 1002 to form a yarn storage system 1000. The rack 1002 is moveably as it is provided with a set of wheels 1004. All tubular containers 1001 are identical, hence have the same length. Tubular containers of which the axial cross sections are shown in FIGS. 1A to 1D can be used.

Using the tubes as shown in FIGS. 1A to 1D, 36 tubular containers 1001 are mount with the first axial extremities 113 being coplanar in vertical plane 1120. The tubular containers 1001 are mount in horizontal position. They are mounted matrix-wise with 6 rows of 6 tubular containers per row. In an alternative version, 9 rows of 18 tubes are mounted in a rack. Between adjacent containers, a distance oft/inch is respected. The tubes can be carried by at least two parallel plates provided with a hole, one for each tube. To hold the tubes in place, the tubes are mount in and supported by at least two parallel plates which are provided with openings, each opening to receive one tube. The openings in the plates have a diameter substantially equal to the outer diameter of the tubes. The distance center-to-center between two such openings is equal to the diameter of the tube plus ¼ inch. The first plate supports the tubes near the first axial extremities, the second plate supports the tubes near the second axial extremities.

In front of the side 1100 providing the openings 123 of the tubular containers 1001, a yarn end holding means being a comb-like beam 1005 is provided which comprises at least as much seats as there are tubular containers in the rack 1002. The yarns 200, e.g. BCF yarns, for each of the tubular containers, are guided to one of the seats in the beam 1005. Such yarn end holding means 1005 is also referred to as comb-spacer or detacheable header. The yarn end holding means can be detached from the rest of the yarn storage system 1000.

Figure 4:
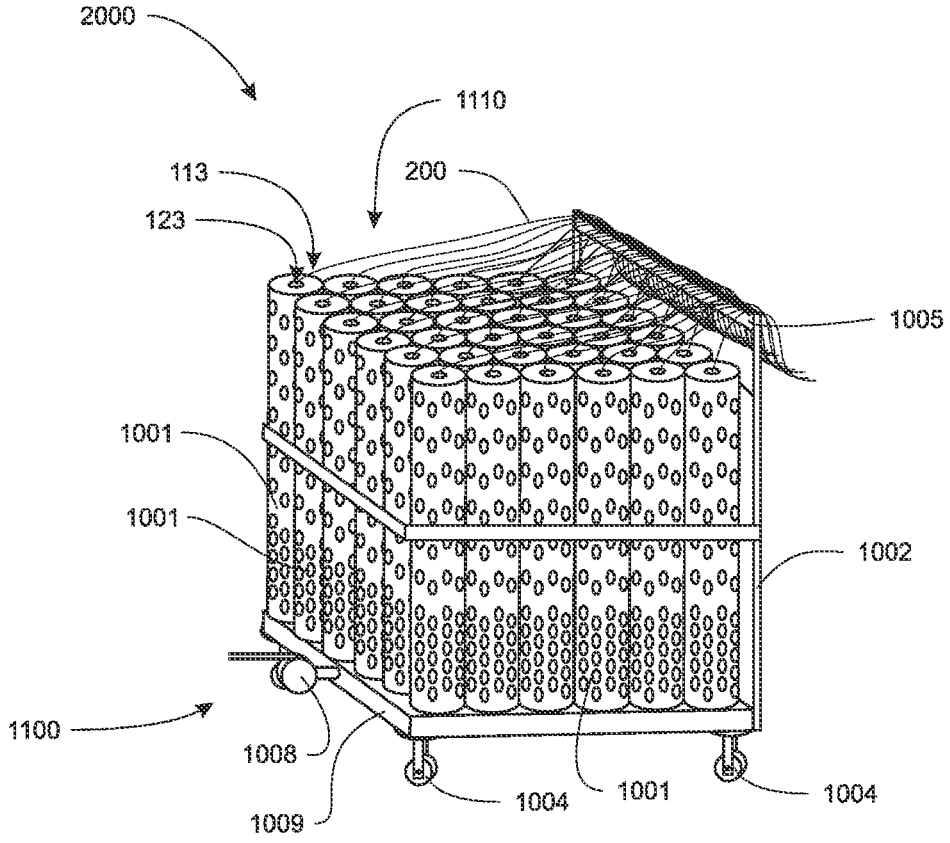

An alternative setup of a yarn storage system 2000 is shown in FIG. 4. The same reference signs refer to the same or similar items. The first axial extremities 113 of the tubular containers 1001 are now coplanar according to a horizontal plane 1110. At the lower side of the rack, a vacuum box 1009 is provided, with which the air permeable second axial extremities are in fluidal connection, i.e. when a vacuum is applied to the box 1009, e.g. by pump 1008, there will be air sucked from each of the second axial extremities, thereby creating a small under-pressure in the inner volume of the tubular containers 1001.

For FIGS. 3 and 4, each of the yarn ends from the yarns 200, extending from the beam 1005, may be coupled to one on one to a needle of a tufting machine (not shown). During providing of the greige by the tufting machine, the yarns are taken substantially tension-less from the tubular containers, and are used as pile yarn in the greige. A greige with a given relatively short length (the length which can be made with the length of pile yarns residing in the tubular containers) of greige can be made. Once finished, a new yarn storage system replaces the emptied one, is coupled to the tufting machine and a new, potentially short run of a potentially different greige can be made. The advantage is that relatively short runs of greige can be provided, while no yarn creel with for each needle a yarn cone, is to be kept at hand.

Figure 5:
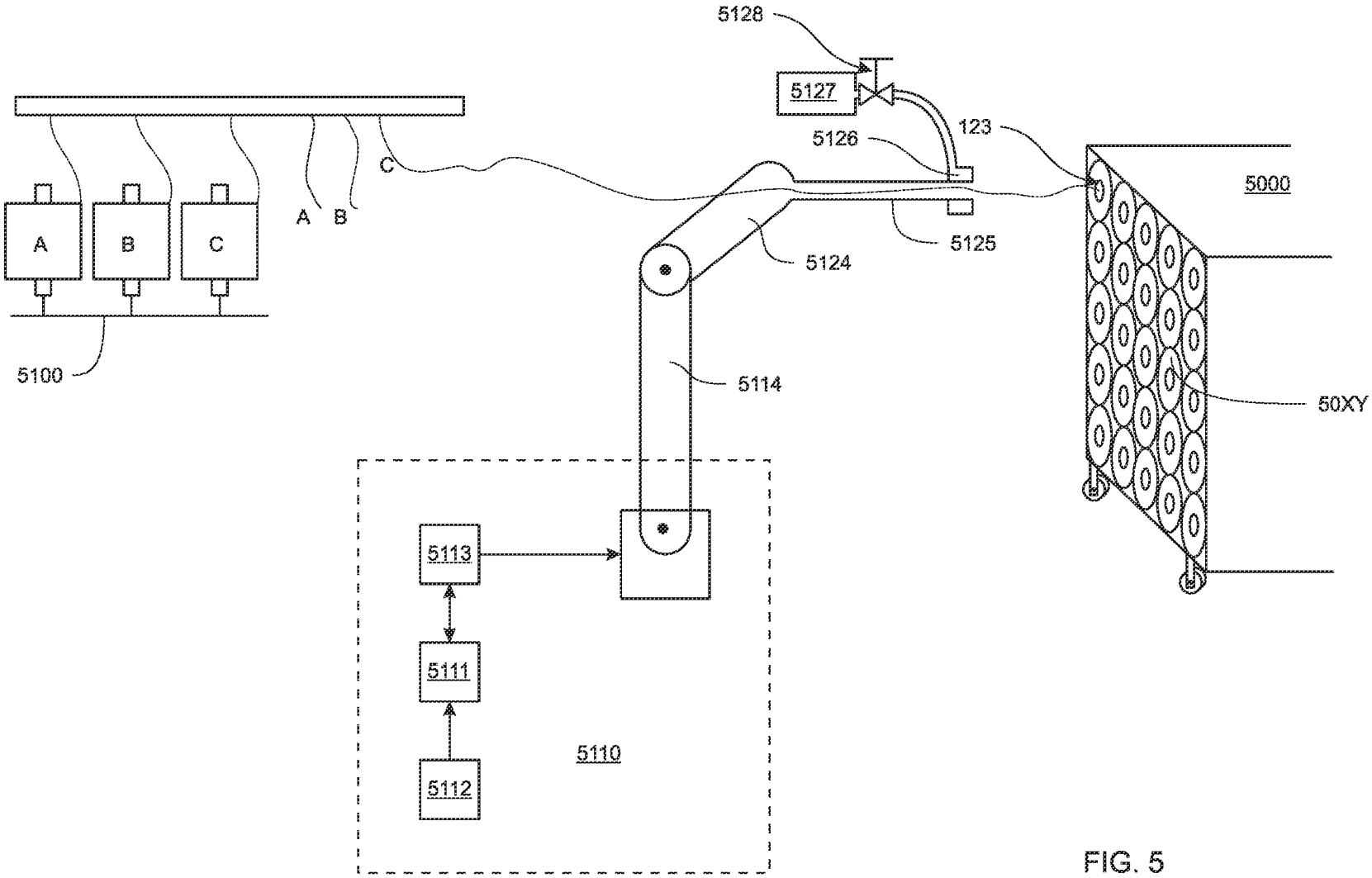
FIG. 5 schematically represents a method to store yarn in a yarn storage system according to the invention.

A system to execute method to store yarn is schematically shown in FIG. 5.

A yarn storage system 5100 is provided. Examples of such system may be the ones shown in FIG. 3 or 4. The tubular containers of this yarn storage system 5100 are named 50XY, where X is an integer varying from 1 to N and Y an integer varying from 1 to M, N being the number of rows in the rack, M being the number of columns in the rack.

A robot 5110 comprises a memory unit 5111 memorizing filling date, being for each tubular container

- its position (X and Y),
- the yarn (in this case yarn A, B or C) to be selected and the length of yarn to be injected
- and optionally, then the yarn storage system comprises a yarn end holding means, like a beam, the position of the opening in the yarn end holding means.

The robot comprises an input means 5112 for inputting the filling date in the memory unit. This input means may be a keyboard to manually put in the data, or a data reading device reading the data from a data carrier (such as a floppy disk, a USB key or any other similar data storage medium), or may even by just an input port for coupling the memory unit to a computer or the web.

The robot comprising a control unit 5113 defining the filling sequence of the tubular containers 50XY and controlling the injection of the selected yarn by means of hardware 5114 in the tubular containers while executing the filling sequence.

In this embodiment, three yarn spools each comprising a BCF yarn (A, B and C) are stored in a rack 5100. Though also only one or two yarns may be used, possibly more than 3 yarns are provided such as 4, 5, 6, 7, 8, 9, 10 or more.

During filling, the control unit will select one tubular container 50XY one after the other and reading out the filling data. In some embodiments, multiple tubular containers 50XY are filled by multiple injectors. The 3D moveable arm 5024 of the hardware 5014, will pick up the end of the selected yarn from the rack 5100 by its air blowing injector 5125. This injector may comprise a vortex injector 5126 which is fed with compressed air from storage 5127 via valve 5128. The injector will be brought in front of the opening 123 of the selected tubular container, and will blow the defined length of yarn into the tubular container via opening 123 using compressed air as fluid.

Once this length is blown in, the injector may be moved in front of the corresponding opening 1006 of the beam 5005, and blows an end of yarn through the opening 1006. The yarn will be a double yarn going through the opening. The yarn is cut and either the same yarn is brought in front of the next selected tubular container, or is brought back to the rack 5100, while the injector 5125 selects another yarn to be used to fill the next tubular container.

This sequence of actions is repeated until all necessary tubular containers are filled.

As such, numerous tubular containers may be filled with a given length of yarn, while only a limited number of yarns on a limited number of spools being available.

Figure 16:
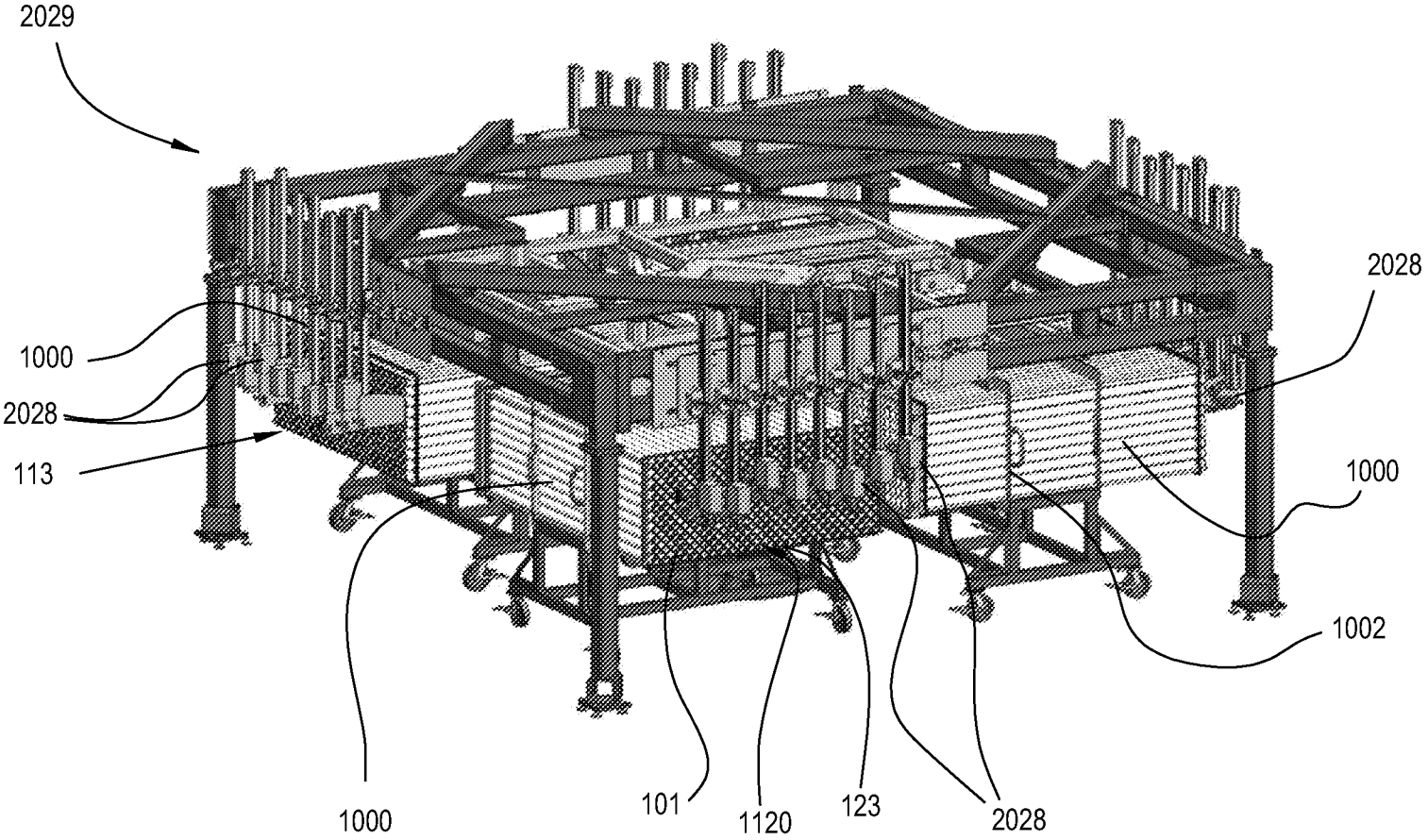
FIG. 16 represents a creeling system in accordance with the fourteenth aspect of the invention.

In another embodiment, multiple yarn storage systems, such as the yarn storage system 5100 of FIG. 5 are provided. A system with multiple sets of air blowing injectors 5125 feeding multiple sets of yarn storage containers 50XY is illustrated in FIG. 16.

It is noted that the yarn end holding means 1005, represented in FIGS. 3 and 4, may comprise means for connecting yarns and/or yarn detectors. Such means for connecting yarns and/or yarn detectors may also be provided separately from the yarn end holding means 1005.

Figure 6:
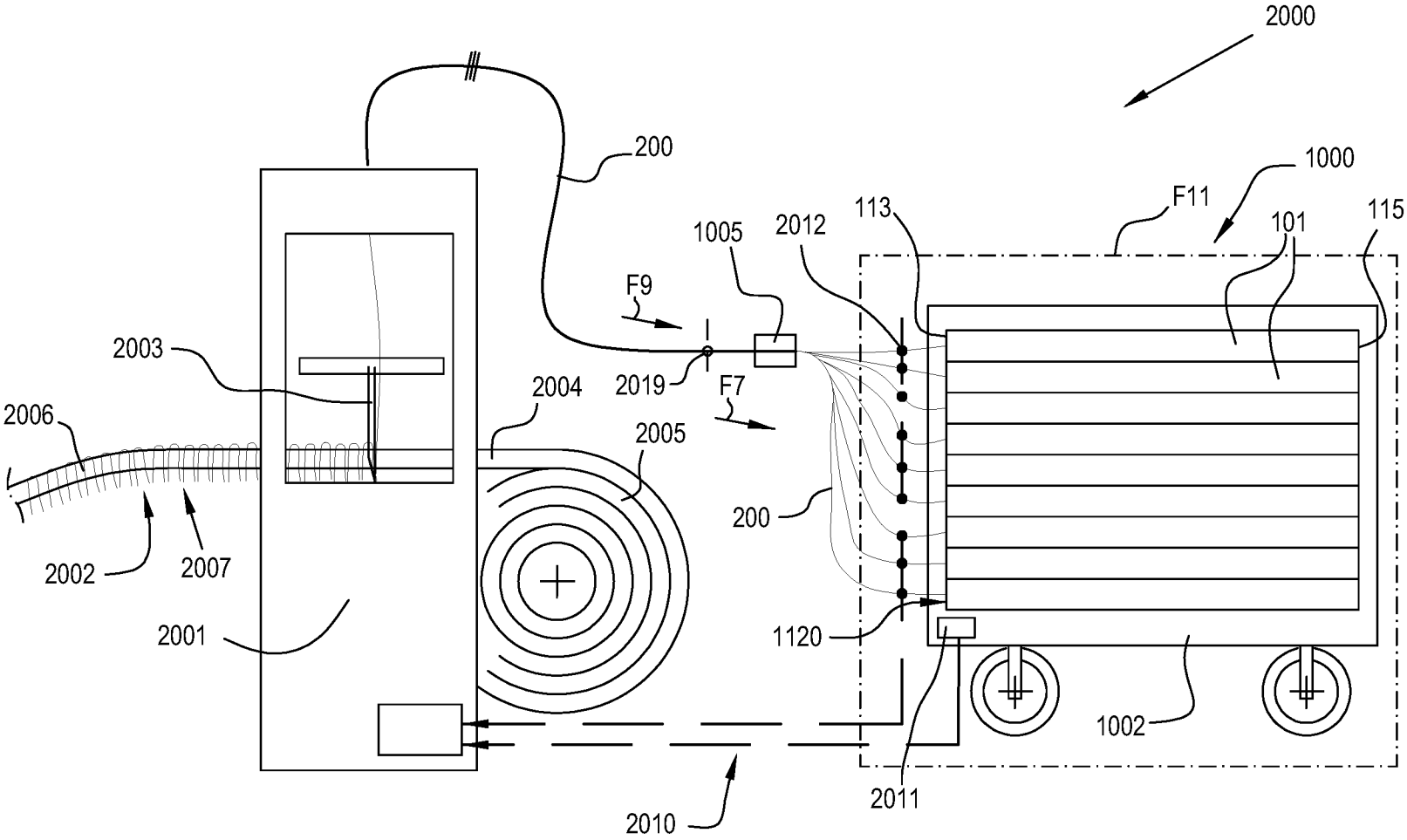
FIG. 6 represents a textile production assembly in accordance with the tenth aspect of the invention.

FIG. 6 represents a textile production assembly 2000. The textile production assembly 2000 comprises a yarn storage system 1000 and a textile producing machine 2001. In this case, the textile production machine 2001 produces textile on the basis of continuous yarn 200 and is a tufting machine wherein said yarn 200 is used to form the pile 2002 of a tufted carpet. As schematically illustrated the tufting machine comprises needles 2003 that plant the pile yarn in to a backing material 2004. In this case, the backing material 2004 is provided from a roll 2005 and may concern a woven or non-woven textile, e.g. a glass fiber layer or a PET fiber layer. As illustrated the planted pile yarn is cut by means of a not represented cutting equipment active below the needles 2003. A greige 2006, it is a tufted backing, leaves the tufting machine, in this case, with its face 2007, i.e. the surface facing the room in use of the carpet, being turned downward. Clearly such greige 2006 may be further finished into a carpet product for example at least by fixing the pile 2002 at the bottom of the greige, here turned upward. The fixing may for example be executed by applying a second backing and/or by applying a latex or coPET containing material.

Figure 7:
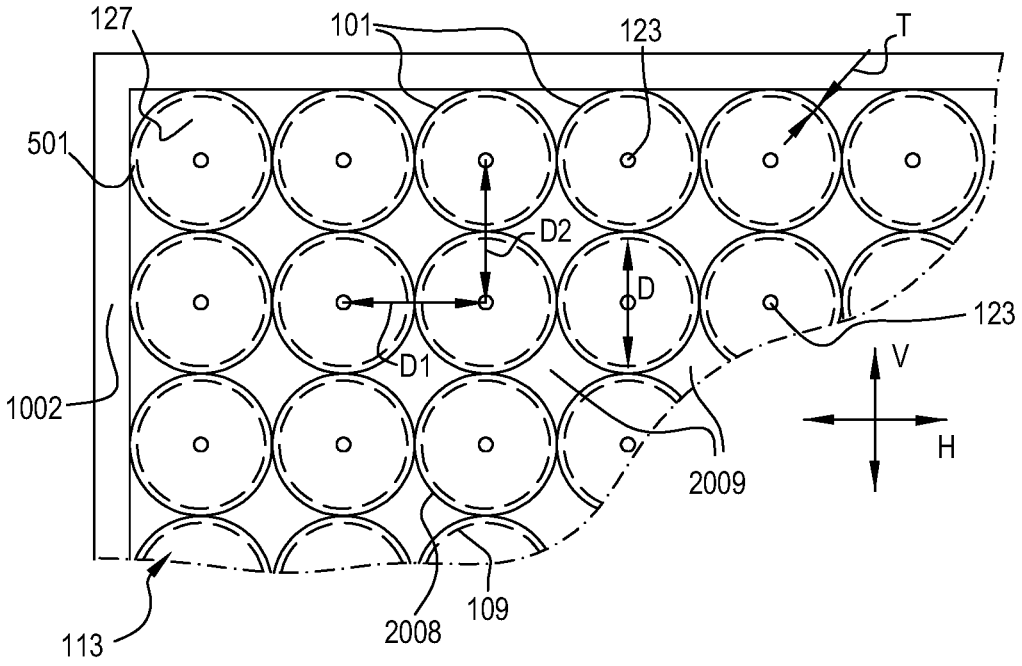
FIG. 7 provides a front view on the yarn storage system of FIG. 6 in accordance with arrow F7.
Figure 8:
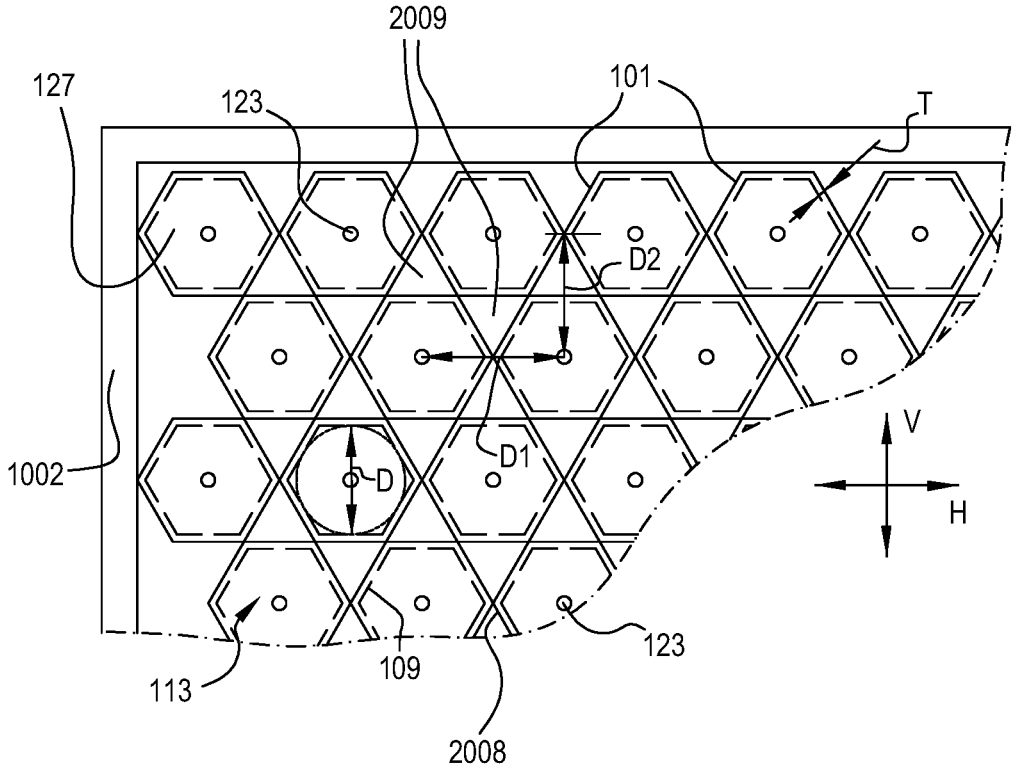
FIG. 8 in a similar view represents a variant.

The yarn storage system 1000 comprises several yarn storage containers 101 that each store an amount of continuous yarn 200, preferably a yarn 200 formed from bulked continuous carpet filament. The yarn 200 is drawn from the first axial extremity 113 of the containers 101. As is illustrated in FIG. 7, the containers 101 are tubular and cylindrical, wherein the first axial extremity 113 comprises a cap 127 with an opening 123 that receives the end of the yarn 200. FIG. 8 shows a variant wherein the containers 101 are hexagonal and also comprise a cap 127 with an opening 123 that receives the end of the yarn 200.

The yarn storage containers 101, as illustrated in FIGS. 7 and 8, are stacked in a matrix, wherein said matrix is substantially uniform. With a uniform matrix it is meant that the axes of the respective containers 101 are positioned equidistantly from each other in a horizontal direction H and/or in a vertical direction V. In this case, the matrix formed by the yarn storage containers 101 of FIGS. 7 and 8 is uniform in both directions, wherein the distance D1 between the containers 101 in horizontal direction H is equal to the distance D2 between the containers 101 in vertical direction V in the case of FIG. 7, while the distance D1 and D2 are different in case of FIG. 8.

FIGS. 7 and 8 further illustrate that at least a part of the outer wall 2008 of the containers 101 is free from contact with any of a plurality of adjacent containers 101. The matrix or stack of containers 101 comprised in said yarn storage system 1000 comprises voids 2009 substantially defined by the outer wall portions of a plurality of containers 101.

In the case of the yarn storage system 1000 of FIG. 6, the containers 101 are positioned, in said storage system 1000 with their axial, i.e. length, direction 111 directed in a horizontal plane.

The yarn storage system 1000 further comprises means 2010 for communicating with said textile producing machine or tufting machine 2001. As illustrated, amongst others in FIG. 6, the yarn storage system 1000 comprises a data storage 2011, and said means 2010 for communicating may transfer data from this data storage 2011 to said textile producing machine or tufting machine 2001.

Further, in this case, the yarn storage system 1000 comprises means 2012 for detecting the yarn of the containers, i.e. yarn detectors, wherein the yarn detectors 2012 create a signal directly communicated to said textile machine through said means 2010 for communicating. Said means 2010 for communicating may be wired electronic connections between the yarn storage system 1000 and the textile production machine or tufting machine 2001.

Figure 9:
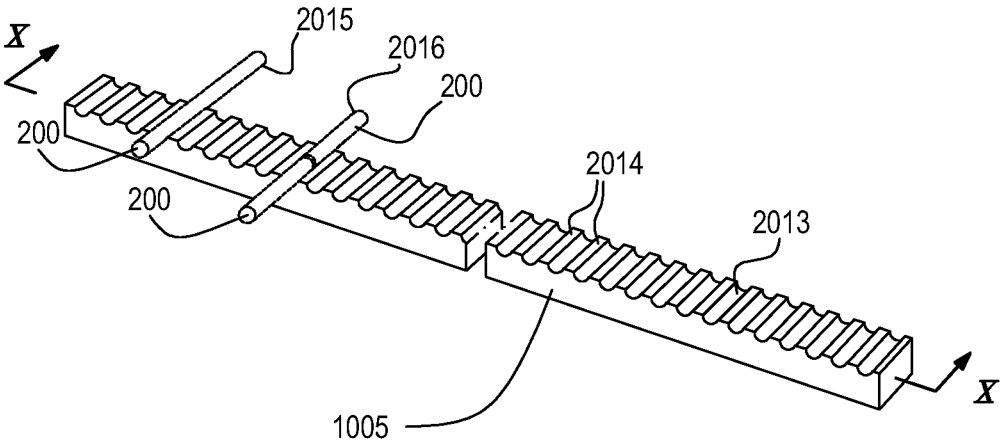
FIG. 9 provides a perspective view on the support of FIG. 6 in accordance with arrow F9.

The illustrated textile production assembly 2000 comprises a yarn end holding means, in the form of a comb-like beam 1005. As illustrated in FIG. 9, the yarn end holding means comprises a number of slots 2013, said number of slots 2013 being identical or more than the number of containers 101 of the yarn storage system 1000, each slot 2013 being fit to receive one yarn end from one of the containers 101. The slots 2013 are all adjacent one next to the other in a row.

In this case, the yarn end holding means is provided as a beam 1005 of metal in which the slots 2013 are provided. The yarn end holding means has a comb-like structure. In this case, the yarn end holding means comprises a set of teeth 2014 or protrusions for spacing individual yarns 200.

The yarn end holding means forms a support for positioning the yarns 200 of said yarn storage system 1000. In dashed line 2015 a continuous yarn 200 is illustrated being fed to the textile production machine over the support. In dashed line 2016 it is illustrated that two yarn ends can be positioned in a slot 2013. This is advantageous for connecting the said yarn ends. In the represented example the two yarn ends are presented end-to-end. This is not necessarily the case. According to variants, the two yarn ends may be presented alongside each other or on top of each other on said support, preferably in a common slot 2013, preferably with their respective ends pointing in opposite directions.

Figure 10:
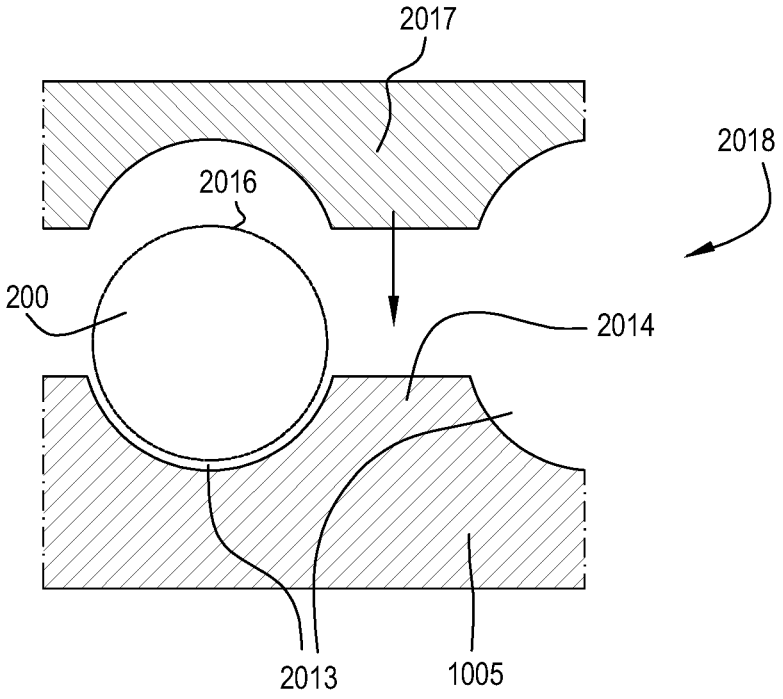
FIG. 10 on a larger scale shows a cross-section according to the line X-X shown in FIG. 6.

FIG. 10 illustrates that a heating and/or pressing element 2017 may be put in contact with the yarn ends to be connected. The heating and/or pressing element 2017 together with the support form a connection means 2018, more particularly a welding equipment, for connecting said yarns 200 while being positioned on said support. Preferably, these connecting means 2018 are used for connecting one or more yarns 200 of a first yarn storage system 1000 to one or more yarns 200 of a second, preferably similar yarn storage system 1000. By using such a welding equipment a fluent change-over from one yarn storage system 1000 to another can be attained, and the tufting machine 2001 may fluently change-over from a first design to a second design, wherein the one yarn storage system 1000 comprises at least the required yarn 200 for said first design and the second yarn storage system 1000 comprises at least the required yarn 200 for said second design. In this way a method for producing textile in accordance with the twelfth aspect can be obtained.

FIG. 6 illustrates that textile production assembly 2000 may alternatively, or in combination with the yarn end detectors 2012 positioned proximate the yarn storage system 1000, be provided with one or more yarn detectors 2019 positioned further downstream, preferably downstream of said support or yarn end holder. Clearly such yarn detectors 2019 may also communicate through said communicating means 2010 with said textile production machine or tufting machine 2001.

Figure 11:
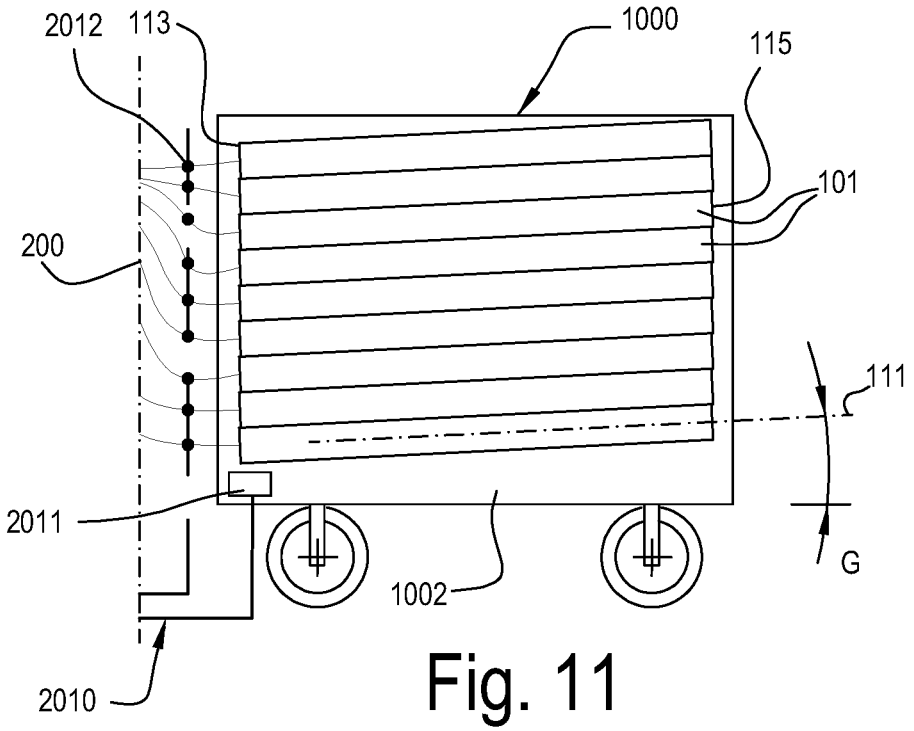
FIGS. 11 to 13 represent variants for the yarn storage system of FIG. 6 in a view on the area indicated with F10 in FIG. 6.
Figure 12:
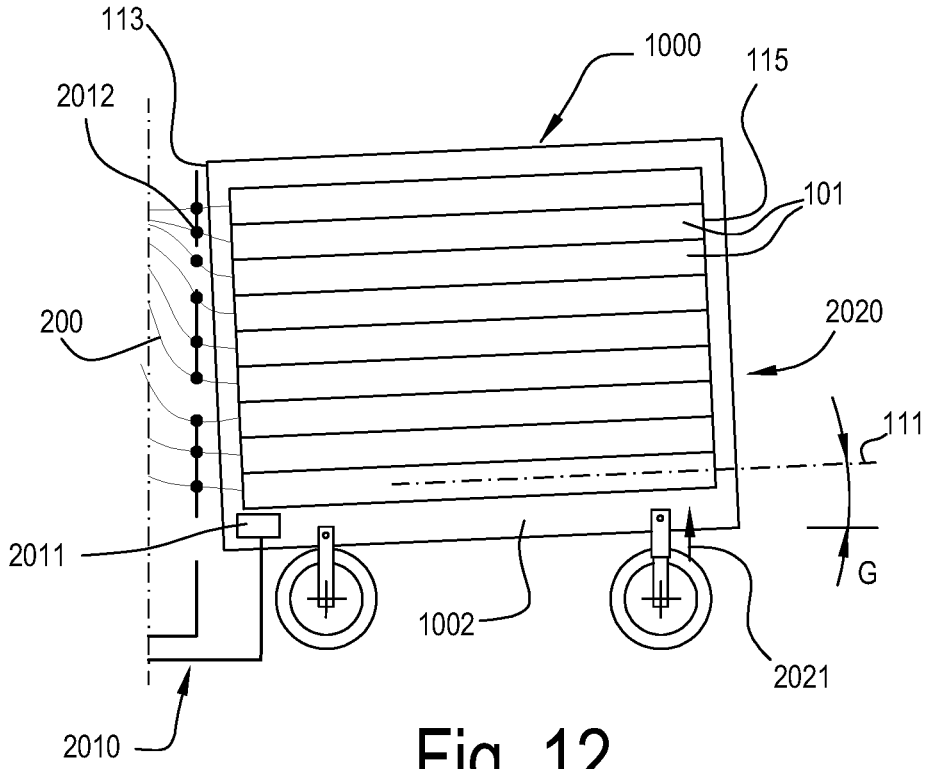

FIGS. 11 and 12 show a yarn storage system 1000 where the containers 101 are positioned, or are postionable, in said storage system 1000 with their axial direction 111 directed slopingly with respect to said horizontal plane, said slope being at an angle G of 15° or less with said horizontal plane. In this case the containers 101 are directed with their first axial extremity 113 being directed downwardly. In the case of FIG. 11 the containers 101 are slopingly mounted in the yarn storage system 1000, while in the case of FIG. 12 the containers 101 are e.g. horizontally mounted in the yarn storage system 1000, but the yarn storage system 1000 can be tilted, for example by lifting the side 2020 of the yarn storage system 1000 proximate the second axial extremity 115 of the containers 101, as indicated by means of the arrow 2021.

Figure 13:
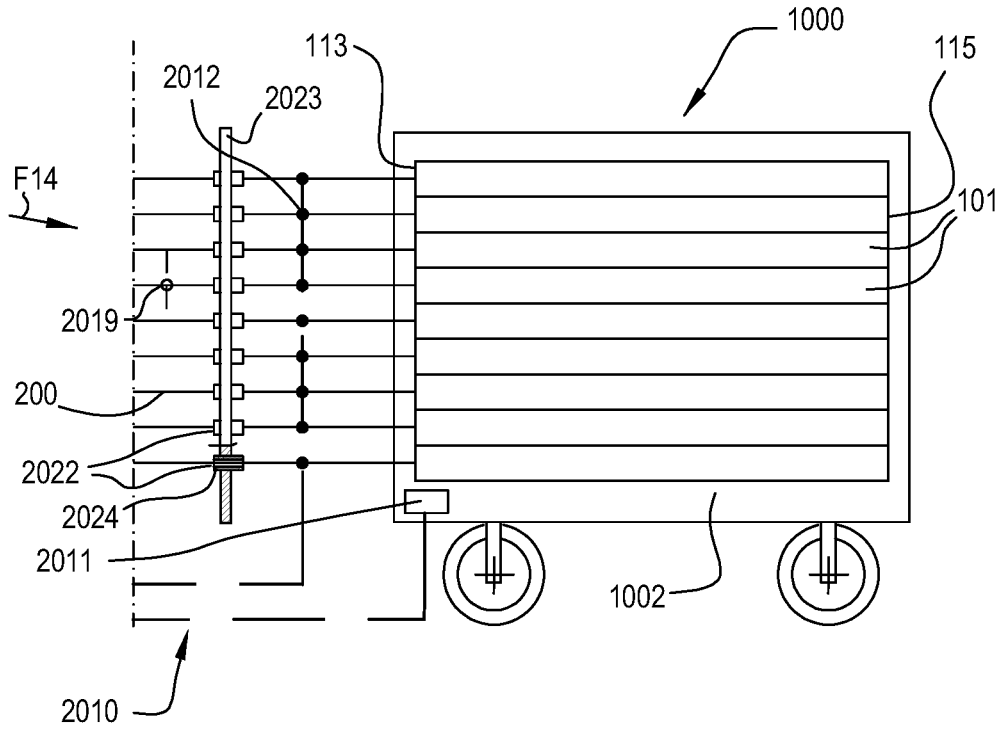
Figure 14:
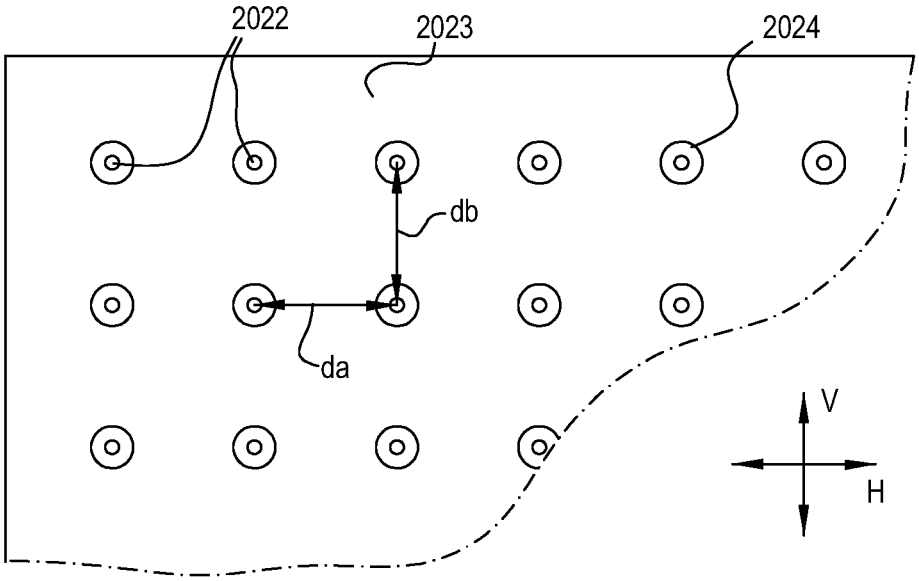
FIG. 14 represent a view in accordance with the arrow F14 of FIG. 13.

FIGS. 13 and 14 illustrate that, alternatively to the yarn end holding means of FIG. 9, or in combination therewith, a yarn end holding means may be provided that comprises a number of apertures 2022, for example formed as a plate 2023 with through bore holes, preferably organized in two or more rows, here arranged in a matrix. In accordance with a not represented embodiment the apertures 2022 may be arranged in a zig-zag setup. Each aperture 2022 is provided with a ceramic tube 2024 to prevent the passing yarn 200 to wear out the aperture 2022. Preferably the yarns 200 pass through said aperture 2022 in the a matrix arrangement that corresponds to the matrix arrangement or the respective containers 101 in the yarn storage system 1001. Preferably therefore the apertures 2022 are provided at distances da-db in the horizontal direction H and/or vertical direction V equal to, or corresponding to the distances D1 and/or D2 defined by the matrix of the containers 101. In the case of a corresponding distance, not being equal, the distance d1-d2 can be uniformly scaled down or up from the distances D1 and/or D2, for example, the distances da-db may each be scaled down to half of the distance D1-D2 respectively.

Figure 15:
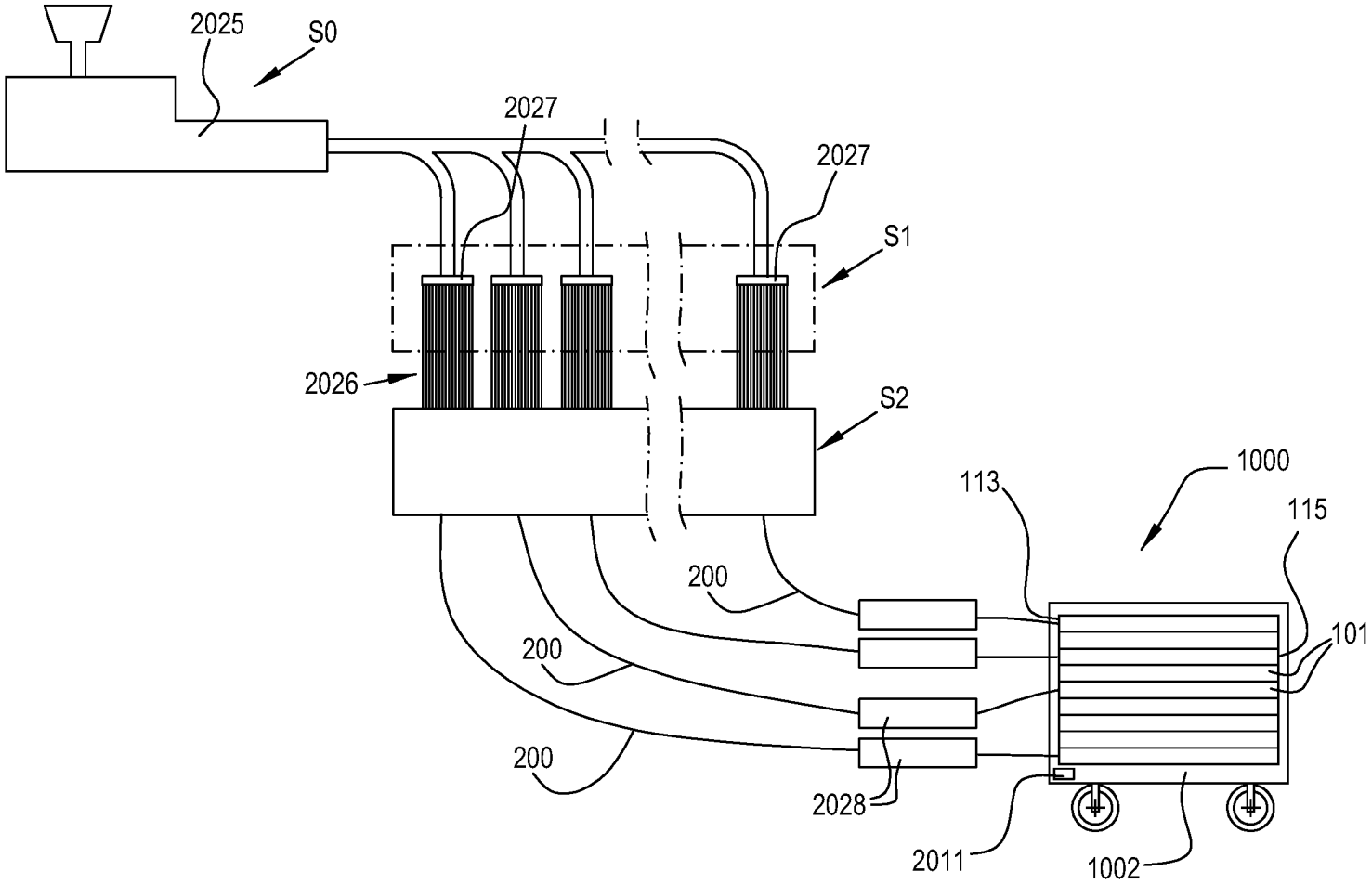
FIG. 15 represents a method for producing yarn in accordance with the thirteenth aspect of the invention.

FIG. 15 illustrates a few steps in a method for producing yarn 200 suitable for feeding a tufting machine 2001. The method comprises the step S0 of melting and extruding a polymer, such as PET or PTT or PA, in this case using an extruder 2025 with one or more rotating screws. The method further comprises the step S1 of spinning the polymer melt into a plurality of filaments 2026. In this case several spinning stations 2027 are fed by the same polymer melt. Each spinning stations 2027 delivers the filaments 2026 for a yarn 200. The method further comprises the step S2 of converting said plurality of filaments 2026 to yarns 200. The conversion may comprise twisting and/or entangling of the filaments 2026. After the conversion the yarns 200 are directly injected into a yarn storage container 101, in this case comprised in a yarn storage system 1000. For the injection pressurized air can be used to propel the yarns 200, for example using vortex injectors 2028. The wholly or partially filled yarn storage system 1000 can then be used for feeding a tufting machine 2001, for example as in FIG. 6 by drawing yarn from the respective containers 101.

FIG. 16 illustrates a creeling system 2029. The creeling system 2029 is configured to receive a plurality of yarn storage systems 1000, in this case four. The creeling system 2029 further comprises several sets of a plurality of injectors 2028 for injecting yarn 200 into the plurality of yarn storage containers 101 comprised in each of the yarn storage systems 1000. Preferably each injector 2028 injects a single type of yarn 200, i.e. yarn from the same color, type, quality and material, into the containers 101 of a particular yarn storage system 1000. As illustrated here, each injector 2028 is able to inject yarn 200 in a plurality of columns of the rack 1002 or stack of containers 101, as the sets of injectors 2028 are configured to move, in this case commonly, horizontally, preferably at least over a distance equal to twice, and preferably at least four times, the horizontal distance D1 between the yarn storage containers 101. Each injector 2028 is, in this case, also able to inject yarn 200 in a plurality of rows of the stack of containers 101, as the injectors 2028 are configured to move, in this case individually, vertically, preferably at least over a distance equal to four times the vertical distance D2 between the yarn storage containers 101. In this case, the injectors are configured to move at least such a distance that they can inject yarn in all containers of a particular row.

The creeling system 2029 may further comprise a memory configured to or comprising the necessary data to direct the at least one set of injectors 2028 for injection of the required length of yarn 200 in each of the yarn storage containers.

It is to be understood that although preferred embodiments and/or materials have been discussed for providing embodiments according to the present invention, various modifications or changes may be made without departing from the scope and spirit of this invention.

The invention claimed is:

1. A yarn storage container comprising:

a tubular container comprising an axial length, an outer wall, and first and second tubular ends, wherein the first tubular end comprises an opening, and the second tubular end comprises a cap;

wherein the outer wall comprises a first section disposed adjacent the first tubular end along the axial length of the tubular container and a second section disposed at the second tubular end along the axial length of the tubular container, and the first and second sections comprise a plurality of openings;

wherein the openings of the first section are spaced apart along the axial length at a first distance, and the openings of the second section are spaced apart at a second distance; and wherein the first distance is greater than the second distance.

2. The yarn storage container of claim 1, wherein the cap is air permeable.

3. The yarn storage container of claim 1, wherein the first tubular end comprises a grommet.

4. The yarn storage container of claim 3, wherein the grommet is removably secured to the first tubular end.

5. The yarn storage container of claim 4, wherein the grommet comprises a brush.

6. The yarn storage container of claim 5, wherein the brush comprises a circular brush with a plurality of bristles oriented towards a central point.

7. A yarn storage system comprising:

a plurality of yarn storage containers of claim 1 comprising a first yarn storage container and a second yarn storage container, wherein the plurality of yarn storage containers are removably secured in a rack that is configured to provide an air flow path between each yarn storage container;

a beam comprising a plurality of seats wherein there are at least as many seats as yarn storage containers; and a data storage and a communications means.

8. The yarn storage system of claim 7, wherein the plurality of storage containers are positioned with their axial length substantially horizontal.

9. The yarn storage system of claim 7, wherein the plurality of storage containers are positioned with their axial length at a slope of substantially 15° from the horizonal.

10. The yarn storage system of claim 7, wherein the first yarn storage container of the plurality of yarn storage containers is configured to receive a first yarn end of a first yarn, and the second yarn storage container of the plurality of yarn storage containers is configured to receive a first yarn end of a second yarn.

11. The yarn storage system of claim 10, wherein a first seat of the plurality of seats is configured to releasably secure a second end of the first yarn, and a second seat of the plurality of seats is configured to releasably secure a second end of the second yarn.

12. The yarn storage system of claim 11, wherein the first yarn storage container is configured for tensionless storage of yarn.

13. A method of filling the first and second yarn storage containers of the yarn storage system of claim 12, comprising:

providing the yarn storage system;

providing a robot comprising a memory unit, an input means, and a control unit;

providing a first yarn and inputting through the input means at least one property of the first yarn, and providing a second yarn and inputting at least one property of the second yarn through the input means;

providing an injector;

moving the injector in front of the first yarn storage container, injecting the first end of the first yarn into the first storage container, cutting the first yarn, and releasably securing the second end of the first yarn in the first seat; and moving the injector in front of the second yarn storage container, injecting the first end of the second yarn into the first storage container, cutting the second yarn, and releasably securing the second end of the second yarn in the second seat.

14. The method of claim 13, further comprising: providing a detector that can detect the at least one property of the first yarn, and the at least one property of the second yarn.

15. The method of claim 14, wherein the at least one property of the first yarn is a length, and the at least one property of the second yarn is a length.

16. The method of claim 15, wherein the length of the first yarn is different from the length of the second yarn.

17. The method of claim 13, wherein the at least one property of the first yarn is a location in the yarn storage container.

18. The method of claim 13, wherein the at least one property of the first yarn is a color.

19. The method of claim 13, further comprising: storing the at least one property in the data storage of the yarn storage system.

20. The method of claim 13, further comprising: moving the yarn storage system away from the robot.

* * * * *